US011348390B2

(12) United States Patent
Tao et al.

(10) Patent No.: US 11,348,390 B2
(45) Date of Patent: May 31, 2022

(54) PADLOCK DEVICE, SYSTEMS INCLUDING A PADLOCK DEVICE, AND METHODS OF OPERATING THEREFOR

(71) Applicant: Tapplock Corporation, Toronto (CA)

(72) Inventors: Ran Tao, Toronto (CA); Jing Yang Wang, Toronto (CA); Jing Hua Ye, North York (CA); Weijie Li, Mississauga (CA)

(73) Assignee: Tapplock Corporation, Toronto (CA)

( * ) Notice: Subject to any disclaimer, the term of this patent is extended or adjusted under 35 U.S.C. 154(b) by 769 days.

(21) Appl. No.: 16/308,608

(22) PCT Filed: Jun. 9, 2017

(86) PCT No.: PCT/CA2017/050707

§ 371 (c)(1),
(2) Date: Dec. 10, 2018

(87) PCT Pub. No.: WO2017/210797

PCT Pub. Date: Dec. 14, 2017

(65) Prior Publication Data

US 2019/0156607 A1 May 23, 2019

Related U.S. Application Data

(60) Provisional application No. 62/348,332, filed on Jun. 10, 2016.

(51) Int. Cl.
*G07C 9/00* (2020.01)
*E05B 67/22* (2006.01)
(Continued)

(52) U.S. Cl.
CPC ..... *G07C 9/00563* (2013.01); *E05B 67/22* (2013.01); *E05B 47/0012* (2013.01);
(Continued)

(58) Field of Classification Search
CPC ..... G07C 9/00
See application file for complete search history.

(56) References Cited

U.S. PATENT DOCUMENTS 6,442,983 B1 * 9/2002 Thomas ..... E05B 47/0012 70/278.1
9,269,208 B2 2/2016 Burke
(Continued)

FOREIGN PATENT DOCUMENTS

AU 2004301168 B2 3/2006
AU 2009201293 B2 4/2009
(Continued)

*Primary Examiner* — K. Wong
(74) *Attorney, Agent, or Firm* — Dickinson Wright LLP; Matthew D. Powell

(57) ABSTRACT

A padlock device includes a housing; a shackle associated within the housing and having, with respect to the housing, a closed configuration and an open configuration; a latch subsystem associated with the housing for securely retaining the shackle in the closed configuration, the latch subsystem electrically operable to release the shackle; a biometric sensor associated with the housing to electronically sense fingerprint data from a finger being sensed; a control subsystem in the housing in communication with the biometric sensor and the latch subsystem, the control subsystem comprising: internal processor-readable memory configured to store one or more fingerprint records, each fingerprint record comprising authorized fingerprint data associated with a respective fingerprint identifier; processing structure configured to receive sensed fingerprint data from the biometric sensor and to cause the latch subsystem to release the shackle in the event of a release condition requiring at least that the sensed fingerprint data corresponds to authorized fingerprint data in at least one of the fingerprint records; the processing structure configured to present a management interface accessible by an external device in authorized
(Continued)

communication with the control system to selectively: store one or more fingerprint records in the internal processor-readable memory; and delete or disable one or more stored fingerprint records in the internal processor-readable memory based at least on one or more respective fingerprint identifiers provided by the external device. A padlock system includes the padlock device; and a processor-readable medium embodying a computer program for provisioning an external device to conduct authorized communications with the padlock device, the computer program including program code for presenting a user interface on the external device for enabling the authorized manager to conduct managing of fingerprint records for the padlock device; and program code for accessing the management interface of the padlock device in accordance with the managing.

29 Claims, 29 Drawing Sheets

(51) Int. Cl.
*E05B 47/00* (2006.01)
*E05B 35/00* (2006.01)

(52) U.S. Cl.
CPC ..... *E05B 2035/009* (2013.01); *E05B 2047/0058* (2013.01); *G07C 9/00896* (2013.01)

(56) References Cited

U.S. PATENT DOCUMENTS

| | | | | |
|---|---|---|---|---|
| 9,665,705 | B2 | 5/2017 | Burke | |
| 10,458,153 | B2 * | 10/2019 | Nguyen | E05B 67/10 |
| 11,069,169 | B2 * | 7/2021 | Huang | H04W 12/08 |
| 2003/0016847 | A1 | 1/2003 | Quintana | |
| 2014/0002239 | A1 | 1/2014 | Rayner | |
| 2016/0145899 | A1 | 5/2016 | Henderson | |

FOREIGN PATENT DOCUMENTS

| | | | |
|---|---|---|---|
| AU | 2015101797 | A4 | 1/2016 |
| CA | 2535434 | | 2/2005 |
| CN | 102158473 | B | 8/2011 |
| CN | 105551125 | A | 5/2016 |
| DE | 202005010400 | U1 | 12/2005 |
| EP | 1661298 | B1 | 5/2006 |
| JP | 2007501981 | | 2/2007 |
| JP | 2012225017 | A | 11/2012 |
| WO | 9934080 | A1 | 7/1999 |
| WO | 2017004719 | A1 | 1/2017 |

* cited by examiner

PADLOCK DEVICE, SYSTEMS INCLUDING A PADLOCK DEVICE, AND METHODS OF OPERATING THEREFOR

CROSS-REFERENCE TO RELATED APPLICATION

This application claims priority to U.S. Provisional Patent Application Ser. No. 62/348,332 filed on Jun. 10, 2016, the contents of which are incorporated by reference in their entirety herein.

FIELD OF THE INVENTION

Embodiments described herein relate to the field of padlocks, and in particular to padlocks which are unlocked through the use of biometric information.

BACKGROUND OF THE INVENTION

Various designs of padlocks are presently available. Padlocks generally comprise a removable shackle that locks into a housing and can be removed from the housing when the housing is unlocked through a user action. Such actions resulting in the unlocking of a padlock may include, for example, inserting a physical key into the lock, or entering the correct combination into a combination lock.

A common feature among the above-mentioned lock types is that the user is required to have either knowledge (e.g. knowledge of the combination) or possession (e.g. possession of a physical key) of the unlocking means in order to unlock the padlock. It is commonplace for a user to forget the combination to a lock, or to misplace the key. Likewise, the key to a lock can be stolen, or the combination to a lock can be ascertained by looking over the user's shoulder while they open the lock, which compromises the security and effectiveness of the lock. Moreover, if the user of a combination lock wants to let someone else access the lock temporarily, they can provide the combination to that other person, but there is no way of forcing that other person to forget the combination. Likewise, if a lock owner allows a friend to borrow their key to the lock, the key can be duplicated. Thus, it is not possible to maintain security with third party users without compromising the effectiveness of the lock to at least some degree.

Conventional lock designs are also vulnerable to "shimming", which is the sliding of additional objects into the channel that accepts the shackle, in order to release the latch which normally prevents the shackle from being withdrawn from the padlock housing.

Accordingly, there is a need for systems and methods for controlling operation of locks which do not require the user to carry a key or memorize additional details, and provide flexibility for granting permission to other users.

There are fingerprint padlocks presently available. These padlocks can be unlocked by scanning authorized fingerprints that were stored during prior setup. The setup phase allows the user to scan and store fingerprints as digital information inside the padlocks to be used at a later time; multiple fingerprints of different users can be stored. However, when the owner decides a user whose fingerprint has already been stored should no longer have access to the lock, the owner must delete all of the fingerprints data stored inside the lock because there is no way to identify which fingerprint belongs to such user; the owner must then setup all of the authorized fingerprints from scratch. There is no way of revoking a user's access without revoking all users' access and causing great inconvenience for the owner. There is also no way to keep track of how many fingerprints have been stored.

SUMMARY OF THE INVENTION

There is a need for systems and methods to manage users, their fingerprints and their accesses that allow the owner to add, delete and make changes to authorized users, fingerprints and accesses in a way that is easy, fast and effective.

There is a need for users to track information associated with the fingerprint accesses and uses of the padlock including but not limited to access history, access location and access user identity.

Fingerprint padlocks require electrical components and are vulnerable to water damage. As padlocks have strong use cases in outdoor environments where exposure to water, snow, rain and other environmental toughness is frequent, there is a strong need for systems and methods that allow various components of fingerprint padlocks to survive these environments.

Fingerprint padlocks and other electrical padlocks all require a power source, generally a battery, to function properly. There is a need for power management and systems and methods to prevent power outages and support the functions of the padlock in case a power outage does occur.

Padlocks have security vulnerabilities that can be exploited by physically forcing the lock casing to be opened.

In accordance with one aspect, there is provided herein a padlock device comprising a housing; a shackle associated within the housing and having, with respect to the housing, a closed configuration and an open configuration; a latch subsystem associated with the housing for securely retaining the shackle in the closed configuration, the latch subsystem electrically operable to release the shackle; a biometric sensor associated with the housing to electronically sense fingerprint data from a finger being sensed; a control subsystem in the housing in communication with the biometric sensor and the latch subsystem, the control subsystem comprising: internal processor-readable memory configured to store one or more fingerprint records, each fingerprint record comprising authorized fingerprint data associated with a respective fingerprint identifier; processing structure configured to receive sensed fingerprint data from the biometric sensor and to cause the latch subsystem to release the shackle in the event of a release condition requiring at least that the sensed fingerprint data corresponds to authorized fingerprint data in at least one of the fingerprint records; the processing structure configured to present a management interface accessible by an external device in authorized communication with the control system to selectively: store one or more fingerprint records in the internal processor-readable memory; and delete or disable one or more stored fingerprint records in the internal processor-readable memory based at least on one or more respective fingerprint identifiers provided by the external device.

In an embodiment, the processing structure is configured to present the management interface accessible by the external device in authorized communication with the control system to selectively cause the latch subsystem to release the shackle without the control subsystem being in the release condition.

In an embodiment, the processing structure is configured to automatically create and store at least one history record in the internal processor-readable memory each time the shackle is released, each history record comprising a fingerprint identifier. In an embodiment, each history record further comprises at least one of: date/time information and location information.

In an embodiment, the electronic management interface is accessible by the external device in authorized communication with the control system to selectively provide at least a subset of the history records to the authorized external device.

In an embodiment, the padlock device is powered by at least one battery and the electronic management interface is accessible by the external device in authorized communication with the control system to selectively provide information about the at least one battery to the authorized external device.

In an embodiment, the control system comprises a wireless transceiver for wirelessly communicating with an external device.

In an embodiment, at least one fingerprint record is stored in association with one or more authorized time windows, wherein the release condition further requires that a time at which the sensed fingerprint data is sensed by the biometric sensor falls within one of the one or more authorized time windows for the corresponding at least one fingerprint record.

In an embodiment, the release condition further requires that additional sensed fingerprint data be sensed by the biometric sensor and that the additional sensed fingerprint data corresponds to authorized fingerprint data in at least one other of the fingerprint records.

In an embodiment, the processing structure is configured to authorize communications with an external device only in the event that the processing structure confirms both a serial number corresponding to the padlock device provided by the external device and a user key corresponding to an authorized manager of the padlock device provided by the external device.

In accordance with another aspect, there is provided a padlock system comprising the padlock device and a processor-readable medium embodying a computer program for provisioning the external device to conduct authorized communications with the padlock device, the computer program comprising program code for authenticating an authorized manager of the padlock device on the external device; program code for causing the external device to retrieve the serial number of the padlock device from a remote server in the event that the authorized manager is authenticated; and program code for sending the retrieved serial number and a user key corresponding to the authorized manager to the padlock device thereby to request the padlock device to authorize communications with the external device.

In accordance with another aspect, there is provided a padlock system comprising the padlock device and a processor-readable medium embodying a computer program for provisioning the external device to conduct authorized communications with the padlock device, the computer program comprising program code for presenting a user interface on the external device for enabling the authorized manager to conduct managing of fingerprint records for the padlock device; and program code for accessing the management interface of the padlock device in accordance with the managing.

In an embodiment, the program code for accessing the management interface comprises program code for generating a new fingerprint identifier; and program code for sending the new fingerprint identifier to the management interface with an instruction to add a new fingerprint record, the processing structure of the padlock device is configured to create and store a new fingerprint record using the new fingerprint identifier and fingerprint data coincidentally electronically sensed by the biometric sensor of the padlock device.

In an embodiment, the program code for accessing the management interface comprises program code for generating a new fingerprint identifier and capturing fingerprint data using the external device; and program code for sending the new fingerprint identifier and the captured fingerprint data to the management interface with an instruction to add a new fingerprint record, wherein the processing structure of the padlock device is configured to create and store a new fingerprint record using the new fingerprint identifier and fingerprint data sent from the external device.

In an embodiment, the program code for accessing the management interface comprises program code for enabling the authorized manager to select a fingerprint identifier; and program code for sending the selected fingerprint identifier to the management interface with an instruction to delete or disable a corresponding fingerprint record stored in the processor-readable memory of the padlock device.

In an embodiment, the processing structure generates the fingerprint identifier. In another embodiment, the fingerprint identifier for a new fingerprint record is received from an external device via the management interface.

In accordance with another aspect, there is provided a method of operating a padlock device having a housing and a shackle associated with the housing, the shackle having, with respect to the housing, a closed configuration and an open configuration, the method comprising storing one or more fingerprint records in an internal processor-readable memory of the padlock device, each fingerprint record comprising authorized fingerprint data associated with a respective fingerprint identifier; causing a latch subsystem associated with the housing to securely retain the shackle in the closed configuration; causing a biometric sensor to electronically sense fingerprint data from a finger being sensed; in the event of a release condition requiring at least that the sensed fingerprint data corresponds to authorized fingerprint data in at least one of the fingerprint records, causing the latch subsystem to release the shackle thereby to enable the shackle to be in the open configuration; presenting a management interface accessible by an external device in authorized communication with the padlock device enabling the external device to selectively: store one or more fingerprint records in the internal processor-readable memory; and delete or disable one or more stored fingerprint records in the internal processor-readable memory based at least on one or more respective fingerprint identifiers provided by the external device.

In accordance with another aspect, there is provided a method of unlocking a padlock, the method comprising: scanning a fingerprint of a user with a sensor; converting the fingerprint into fingerprint digital data; comparing the digital data to a set of at least one record of fingerprint digital data; and unlocking the padlock if the converted fingerprint digital data corresponds to one of the set of at least one record of fingerprint digital data.

In accordance with another aspect, there is provided a method of registering a padlock comprising a memory with an owner account, the method comprising: connecting the padlock with an external device; generate a unique lock ID and store the lock ID in the local memory of the padlock device if no existing lock ID is found in the memory; store the lock ID in an online database.

In accordance with another aspect, there is provided a method of associating a registered fingerprint with at least one stored data point in an external database. This association can then be used to read, identify, manage, add, delete or control users, fingerprints, accesses, and other relevant functions.

In accordance with another aspect, there is provided a method of connecting the padlock with an external device, which having or is connected to a screen or display, having or is connected to an input source and having access to a database, can be used to display information about the padlock and its stored fingerprints and control, manage, add, delete or control fingerprints, users and accesses pertaining to the connected padlock.

In accordance with another aspect, there is provided a method of collecting information about each access and its user at the time of access and transmitting and storing this information in an online database. This information can then be displayed or used for other purposes like displaying, analysis, reporting, calculations, etc.

In accordance with another aspect, there is provided a method of protecting the padlock from water damage using mechanical designs that prevent water from affecting the padlock's electrical components.

In accordance with another aspect, there is provided a method of replenishing the power source of the padlock without moving, changing or removing physical components of the padlock.

In accordance with another aspect, there is provided a method of preventing power outages by reminding the user to replenish the power source when the power source reaches certain levels.

In accordance with another aspect, there is provided a method of minimizing consumption of power to increase the power source's lifespan and decrease the frequency and time needed to replenish the power source.

In accordance with another aspect, there is provided a method of unlocking the padlock using a button on the padlock without using fingerprints, keys and external devices.

BRIEF DESCRIPTION OF THE DRAWINGS

Some embodiments of the invention are explained in further detail below with reference to the figures, which are intended to illustrate only example embodiments and not to limit the scope of the invention, in which.

DETAILED DESCRIPTION OF THE EMBODIMENTS

Described herein are example embodiments which are not intended to be limiting on the scope of the invention. The following are merely examples which illustrate some of the concepts described herein.

Figure 1:
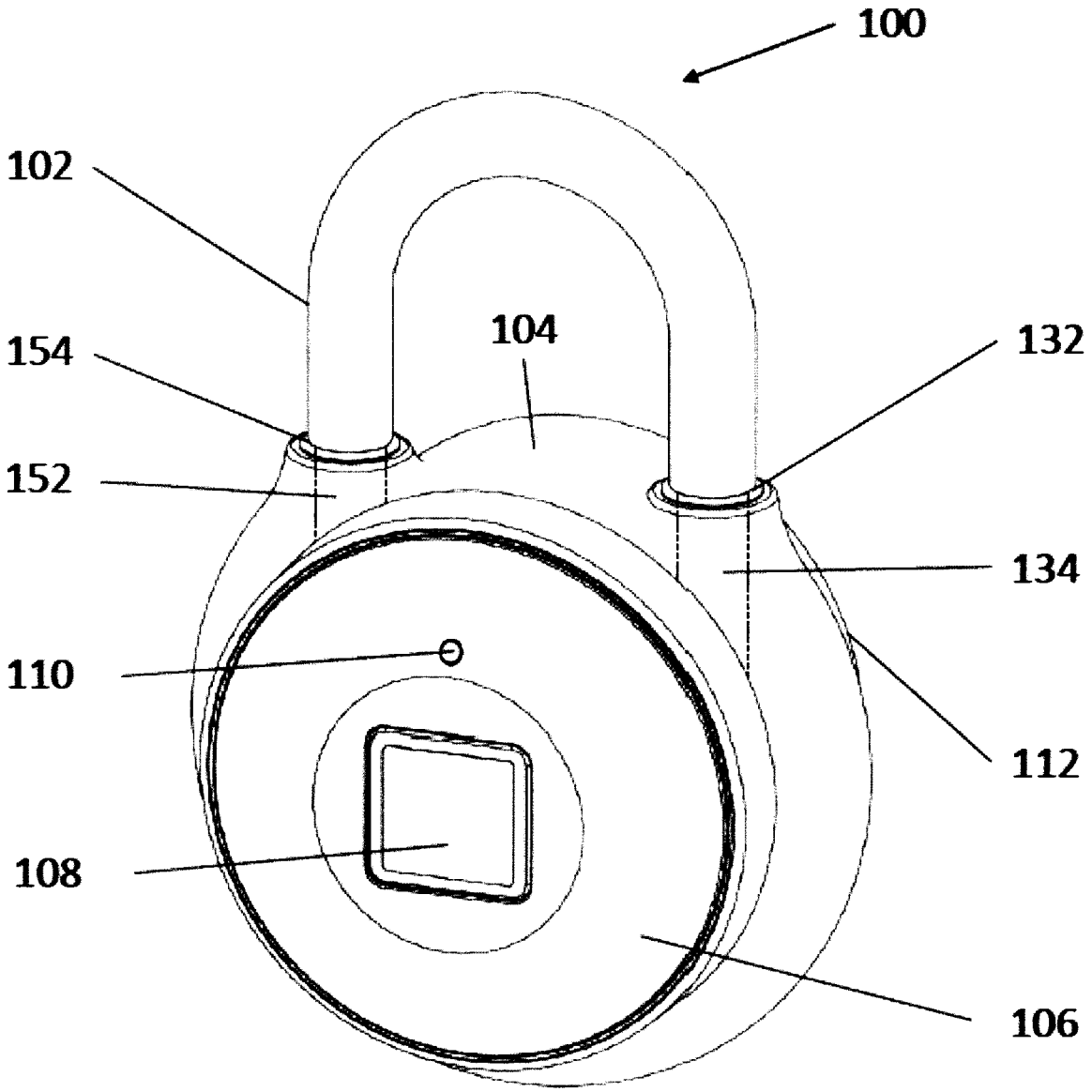
FIG. 1 is an isometric view of the front side of a padlock device according to an embodiment of the invention.

FIG. 1 is an isometric view of the front side of a padlock device 100 according to an embodiment. Padlock device 100 includes a shackle 102 associated with a housing 104 and that may be in an open configuration or in a closed configuration with respect to housing 104, and may be securely retained in the closed configuration, and released, as will be described. Housing 104 comprises a first channel 132 which is adapted to accept a first portion 134 of shackle 102, and a second channel 154 which accepts a second portion 152 of shackle 102. Padlock device 100 comprises a front cover 106 and a rear cover 112. In this embodiment, front cover 106 of padlock device 100 has an opening for framing a biometric sensor 108 which, in this embodiment, is a capacitive-type fingerprint sensor for electronically sensing fingerprint data from a finger being sensed.

A light-emitting diode (LED) 110 is visible through the front cover 106 and, in this embodiment, serves as a state- or status-indicator for padlock device 100. For example, when padlock device 100 is in an unlocked state, LED 110 is driven to turn green. When padlock device 100 is in a locked state but is connected to another device via Bluetooth, LED 110 is driven to turn blue. When a user provides a fingerprint which is not accepted by padlock device 100, LED 110 is driven to turn red.

Figure 2:
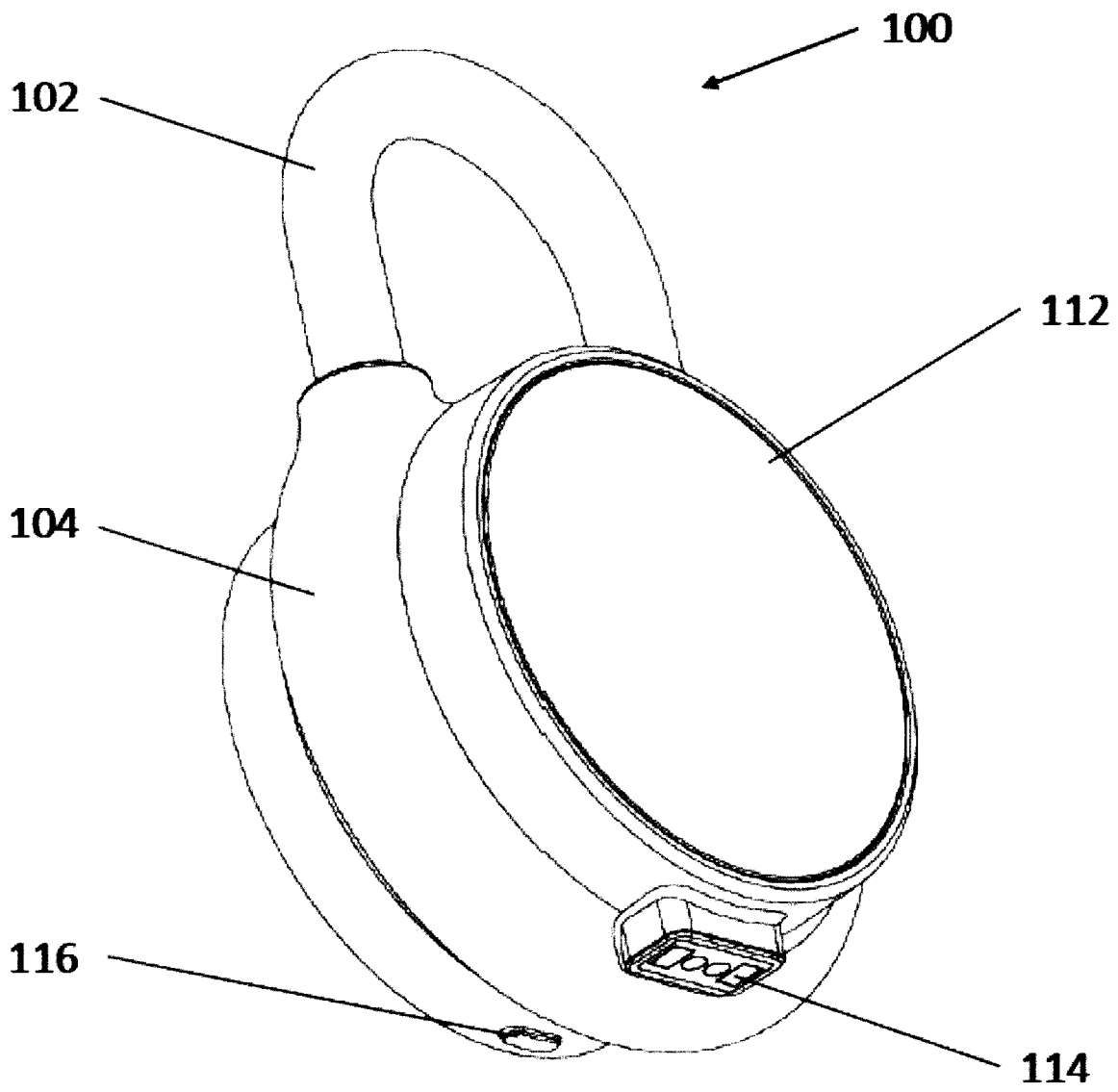
FIG. 2 is an isometric view of the rear side of the padlock device of FIG. 1.

FIG. 2 is an isometric view of the rear side of padlock device 100. A rear cover 112 is shown prominently in FIG. 2, as is a charging port 114. Charging port 114 is configured to interface with a corresponding charging cable (not shown), to convey current to an internal power source (a battery 164, shown in FIG. 3, in this embodiment) of padlock device 100. In this embodiment, charging port 114 can also interface with a charging cable to convey current from battery 164 for charging other external electronic devices such as smartphones.

Figure 3:
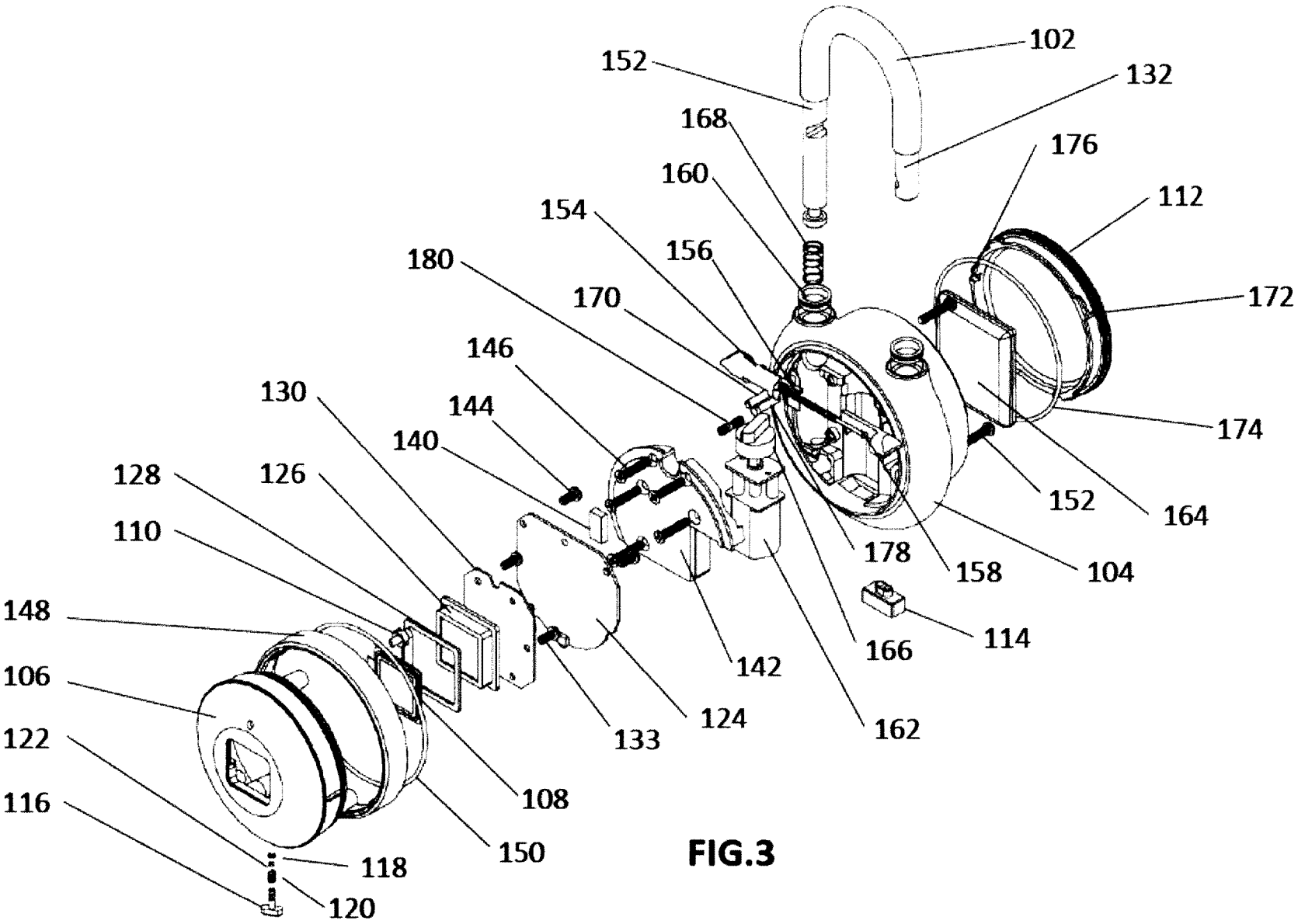
FIG. 3 is an exploded perspective view of the padlock device of FIG. 1.

FIG. 3 is an exploded perspective view of padlock device 100. A power button 116 is externally accessible through front cover 106, and is mounted thereto through an E-ring 118 for preventing power button 116 from detaching from front cover 106. A tiny spring 120 is mounted to the columnar portion of power button 116 to ensure power button 116 returns to an OFF position after being depressed to its ON position. In this embodiment, power button 116 interfaces with a tiny O-ring 122 for inhibiting one or more of water, dust and mist from entering the interior of padlock device 100 through the aperture in housing 104 through which power button 116 is exposed to a user. When a user presses power button 116, power button 116 in turn actuates a switch mounted on a printed circuit board (PCB) 124, thereby to activate the power and/or other states of padlock device 100, such as a Bluetooth connection mode as will be described.

In this embodiment, biometric sensor 108 is a capacitive fingerprint sensor produced by Fingerprint Cards AB of Sweden under model number FPC 1020 and is mounted within front cover 106 along with a plastic insulator 126 equipped with a sensor gasket 128. Sensor gasket 128 achieves a similar sealing function for housing 104 and biometric sensor 108 as does O-ring 122 for power button 116. In this embodiment, biometric sensor 108, plastic insulator 126 and sensor gasket 128 are mounted to front cover 106 by fastening a sensor rear cover 130 to front cover 106 using one or more screws 133.

Biometric sensor 108 is electrically connected to be in communications with a processing structure 135 supported on PCB 124. In this embodiment, processing structure 135 is a coordinated set of two microprocessors mounted in communications with each other on PCB 124. In particular, in this embodiment, the first microprocessor is a Multiprotocol Bluetooth chip provided by Nordic Semiconductor of Trondheim, Norway under model number nRF51822-QFAC and the second microprocessor is a 32-bit ARM® Cortex®-M3 Microcontroller provided by ARM Inc. of Cambridge, U.K. under model Cortex-M3. In this embodiment, the first microprocessor serves as a master controller of padlock device 100 and the second microprocessor, controlled by the first processor, is used mainly to process sensed fingerprints as will be described.

Figure 4:
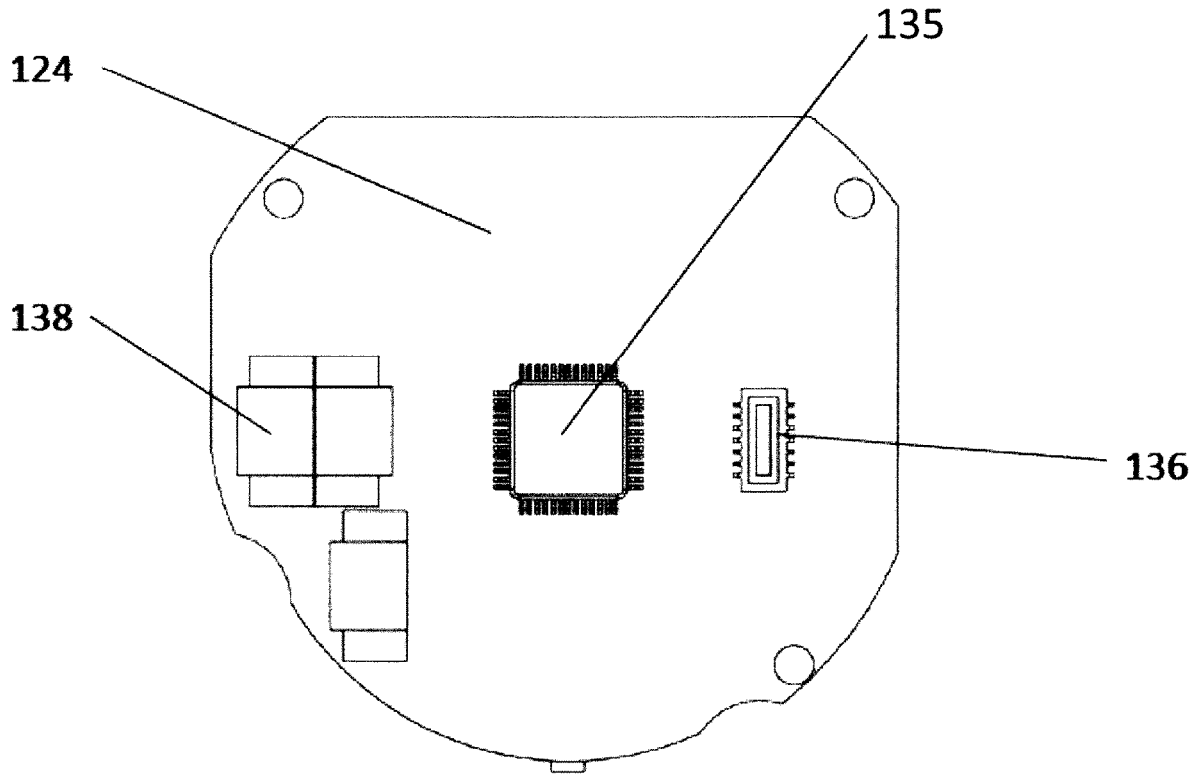
FIG. 4 is a front view of a printed circuit board (PCB) subassembly of the padlock device in FIG. 1.

FIG. 4 is a front view of PCB 124. Processing structure 135 and a female connector 136 for receiving a counterpart male connector extending from biometric sensor 108 are shown in FIG. 4. In this embodiment, PCB 124 also supports a number of surface mounted connectors 138, which are used for electrical connection. PCB 124 also supports an internal processor-readable memory associated with processing structure 135.

Figure 5:
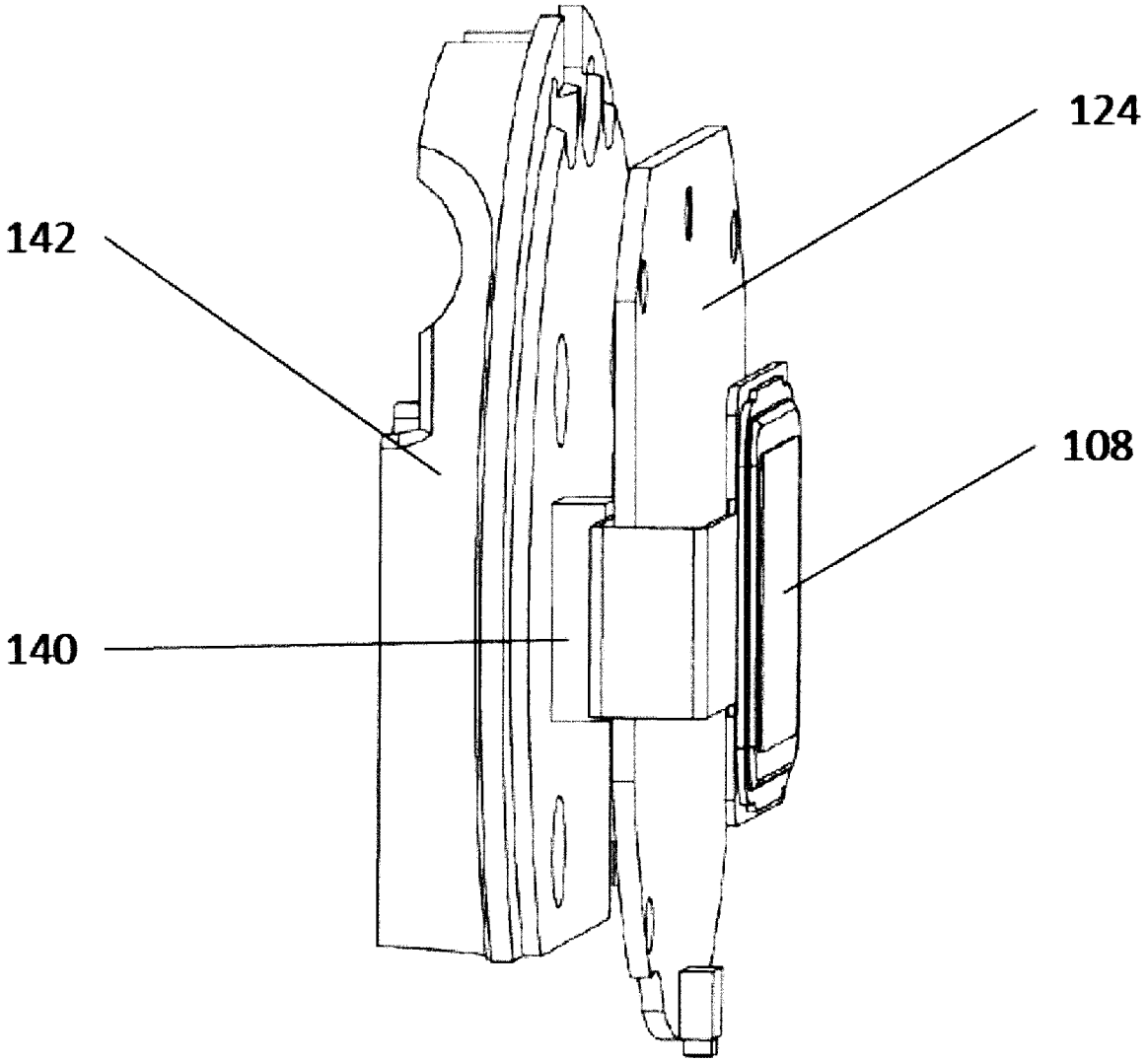
FIG. 5 is a partial perspective view of the PCB subassembly of FIG. 4.

FIG. 5 is a partial perspective view of PCB 124. As seen in FIG. 5, an ethylene-vinyl acetate (EVA) pad 140 is associated with an isolating plate 142 and is located behind biometric sensor female connector portion 136. EVA pad 140 reinforces the connection between biometric sensor 108 and PCB 124. PCB 124 is mounted to front cover 106 using screws 144.

FIG. 5, which does not show all of the components, does show a clear alignment relationship among biometric sensor 108, PCB 124, EVA pad 140 and isolating plate 142. Isolating plate 142 is mounted to housing 104 using screws 146. Isolating plate 142 separates PCB 124 from the mechanical elements described hereinafter. In this embodiment, front cover 106 comprises a decorative ring 148 that also reinforces the stiffness of front cover 106 and a rubber ring 150 positioned between the two as somewhat of a gasket for preventing one or more of water, dust and mist from entering the interior of padlock device 100. Front cover 106 is fastened to the rest of housing 104 by, for example, screws 152, and decorative ring 148 is fixed between front cover 106 and housing 104.

Padlock device 100 includes a latch subsystem for securely retaining shackle 102 in the closed configuration, as will be described in further detail. In this embodiment, latch subsystem includes two latches 155 which make contact with shackle 102 so as to securely retain shackle 102 when padlock device 100 is in the closed configuration. Two long springs 156 are mounted inside latches 155 to bias latches 155 to a retention position. Two small metal shafts 158 are mounted concentrically with springs 156 to guide movement between retain (locked) and release (unlocked) positions of latches 155.

Figure 6:
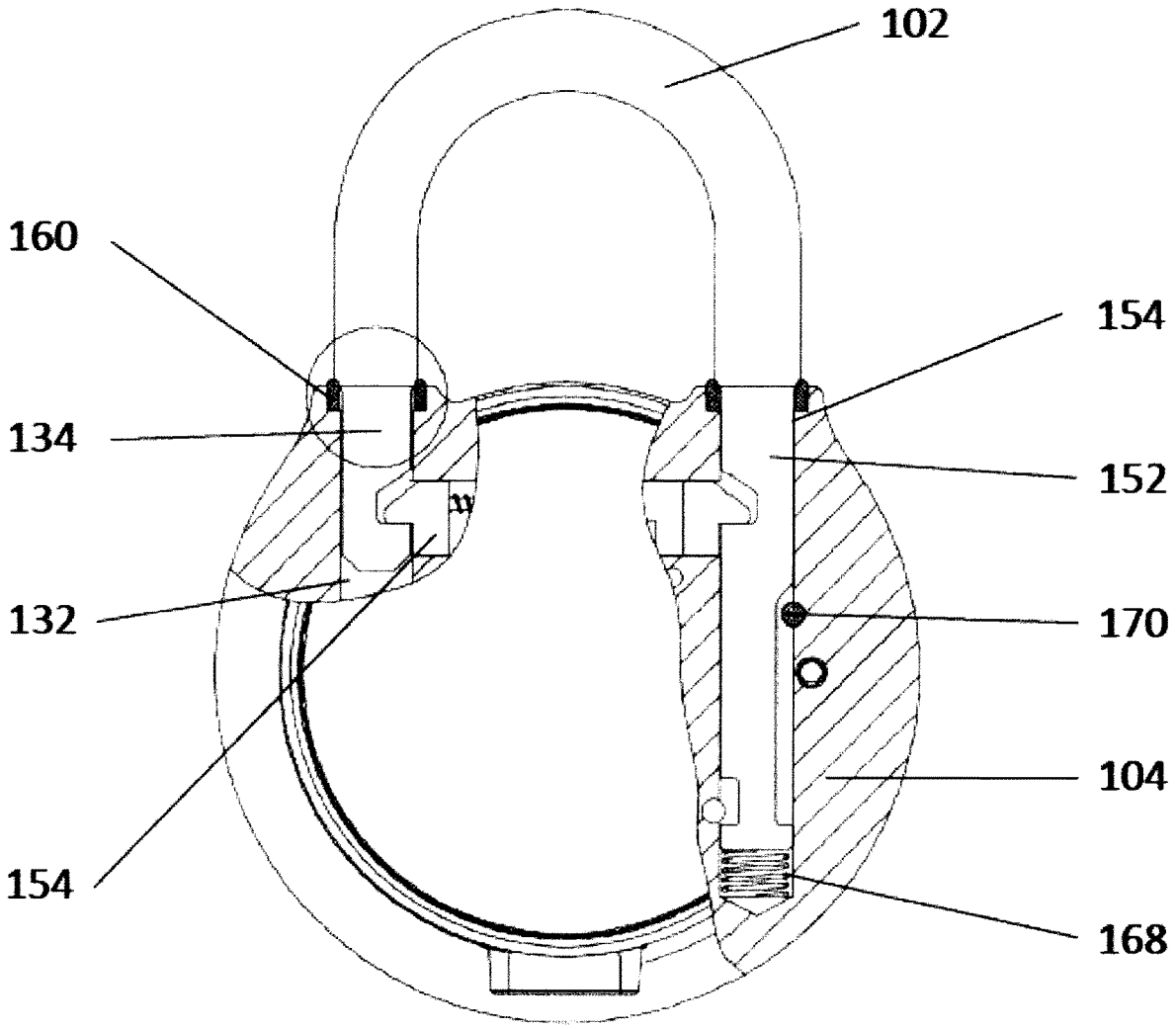
FIG. 6 is a partial cross-sectional view of the padlock device of FIG. 1.

FIG. 6 is a partial cross-sectional view of padlock device 100. As shown in FIG. 6, in the closed configuration, a first portion 134 of shackle 102 is received in a channel 132 and a second portion 152 of shackle 102 is received in a channel 154. Latches 155 in the locked position prevent withdrawal of first portion 134 and second portion 152 of shackle 102 from respective channels 132 and 154. In the locked position, the wider portions of shackle 102 press against rubber rings 160 mounted on housing 104. Rubber rings 160 inhibit liquid, dust and mist from entering the interior of padlock device 100 while padlock device 100 is closed and particularly while locked.

In this embodiment the latch subsystem further comprises a motor 162 in driving engagement via a rotor 166 with latches 155 and also powered by battery 164. Motor 162 is in electrical communication with processing structure 135, in particular the first microprocessor in this embodiment, via terminals on PCB 124 thereby to enable processing structure 135 to communicate with the latch subsystem. In the event of a release condition as will be described in further detail below a signal is sent by processing structure 135 to actuate motor 162, which serves to rotate rotor 166 to, in turn, cause latches 155 to recede inwards thereby to releases each portion 134, 152 of shackle 102 to enable shackle 102 to be moved to its open configuration.

In the unlocked position, a spring 168 having been compressed against its bias by second portion 154, is able to push second portion 154, and thus entire shackle 102, upwards until it reaches its rest position. Once this is done, perhaps after a very short delay to enable spring 168 to work against any friction, motor 162 is stopped by processing structure 135 from being actuated against the bias of springs 156 for latches 155 thus enabling latches 155 to return to their rest position—that is their extended or locked position. Shackle 102 having been moved upwards by spring 168 away from latches 155 remains in an unlocked state and free to be moved to an open configuration, for looping through some object to be locked, until such time as its portions 134, 152 are pushed back downwards into respective channels 132, 154 to be engaged again by latches 155.

When first portion 134 of shackle 102 is removed from channel 132, shackle 102 is prevented from being completely separated from housing 104, as second portion 152 of shackle 102 (which is longer in length than first portion 134) is prevented from being completely removed from second channel 154 of housing 104 by a rivet 170. Shackle 102 may, however, be freely rotated while retained within housing 104 about an axis aligned with second portion 152.

In this embodiment, once unlocked and first portion 134 of shackle 102 is removed, a user can manually close and re-lock shackle 102 by re-inserting first portion 134 into channel 132 far enough to engage latches 155, and thereby push them slightly back against the bias of springs 156 until latches 155 can snap back into respective slots in portions 134 and 152.

Figure 6A:
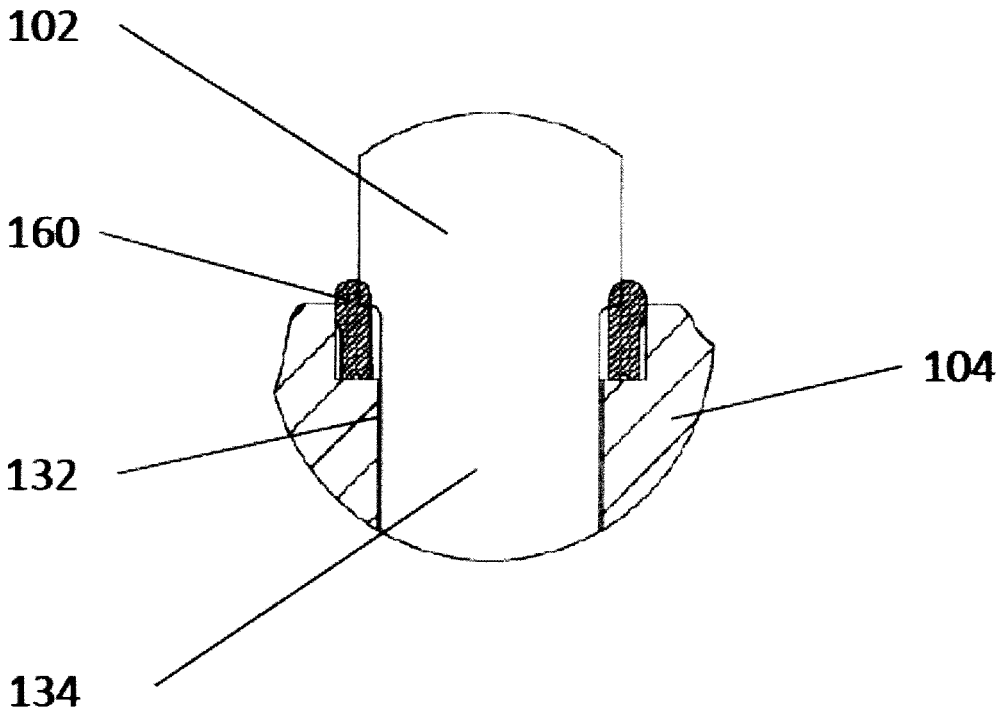
FIG. 6A is a magnified cross-sectional view of the encircled portion of FIG. 6, illustrating an interface between a channel and a shackle.

Referring once again to FIG. 6, in this embodiment a lower part of first portion 134 of shackle 102 has a different, smaller, diameter from other portions of shackle 102. This multi-diameter design is for reducing the ease and therefore the likelihood of shimming —the insertion of foreign objects into channel 132 and channel 154 in addition to the first portion 134 and the second portion 152 of the shackle 102 in an attempt to manually release latches 155. As can be seen in FIG. 6 and in particular FIG. 6A, the diameter of first portion 134 of shackle 102 is small enough to be inserted into channel 132, while the diameter of the portion of shackle 102 which does not penetrate channel 132 is sufficiently large to obstruct and, it is hoped, prevent the insertion of any additional objects or sheets into channel 132. FIG. 6A is a magnified view of the interface between first portion 134 of shackle 102 at the point of insertion into channel 132.

Figure 7:
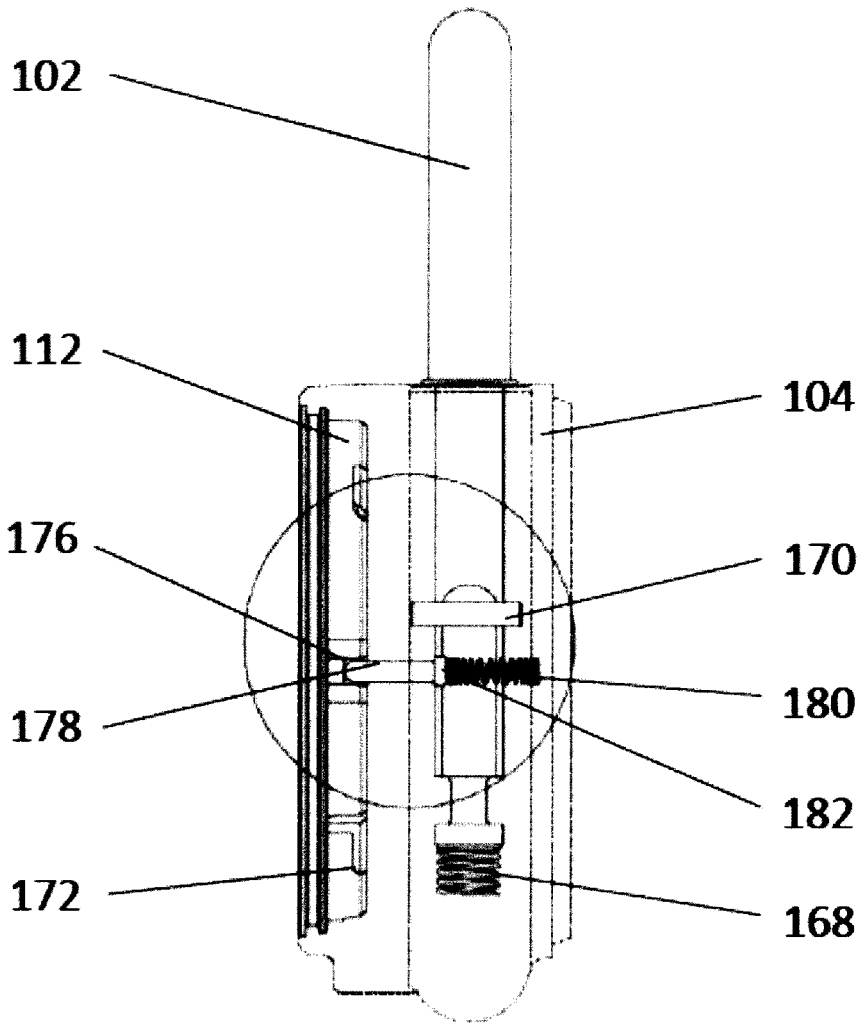
FIG. 7 is a cross-sectional side view of the padlock device of FIG. 1.

As disclosed above, in this embodiment, screws 152 fasten front cover 106 to housing 104, thus enclosing the internal components on the front side of the padlock device 100. The rear side of padlock device 100 (as shown in FIG. 2) is secured by rear cover 112. FIG. 7 shows a side view of padlock device 100 in a locked configuration without the front portions, thus providing a view of the internal mechanism for securing rear cover 112 to padlock device 100. As shown in FIG. 7, rear cover 112 is secured into housing 104 by four clasps 172. Thus, in order to remove or insert rear cover 112, rear cover 112 must be rotated in order to release or lock clasps 172. In this embodiment, a rubber ring 174 seals rear cover 112 in the same manner as rubber ring 150 seals front cover 106.

Figure 7A:
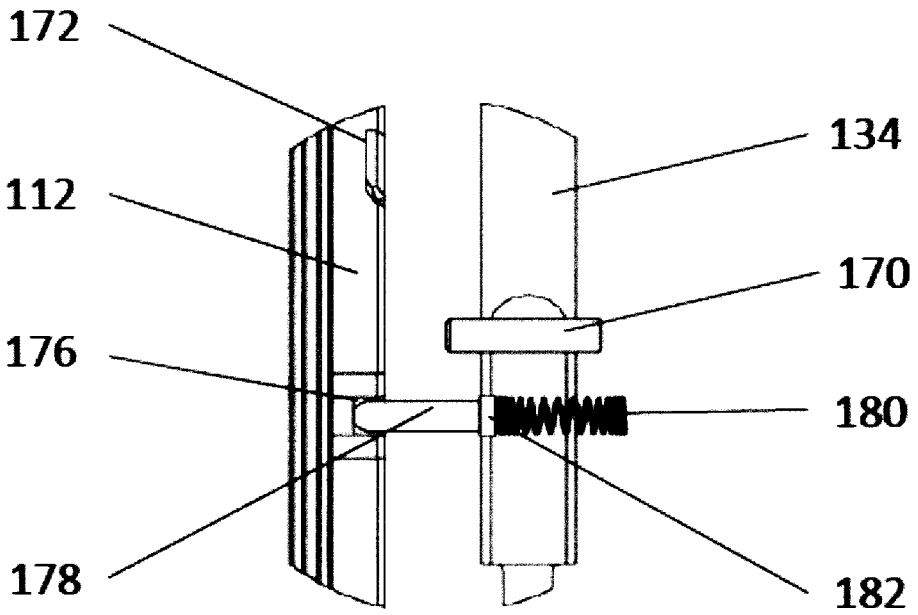
FIG. 7A is a magnified cross-sectional view of the encircled portion of FIG. 7, illustrating a mechanism for securing a rear cover of the padlock device.

FIG. 7 is a cross-sectional side view of the padlock device 100, and FIG. 7A is a magnified cross-sectional view of the encircled portion of FIG. 7, illustrating a mechanism for securing rear cover 112 of padlock device 100. Rear cover 112 comprises a cavity 176 which accommodates a stop pin 178. Stop pin 178 is inserted into cavity 176 and is biased outwardly by spring 160. Stop pin 178 is prevented from completely exiting housing 104 by the interference between the bigger diameter portion 182 of stop pin 178 and housing 104. When stop pin 178 is penetrating cavity 176, rotation of rear cover 112 is prevented. Thus, rear cover 112 is prevented by stop pin 178 from being removed, and if such a removal were successful it would result in damage to padlock device 100. FIG. 7A provide magnified views of padlock device 100 in a closed position, in which spring 180 is pushing stop pin 178 into cavity 176, thus preventing rotation of rear cover 112.

In this embodiment, padlock device 100 operates in conjunction with various software and hardware systems as described herein. For example, in this embodiment, the internal processor-readable memory and processing structure 135 are configured to together serve as a control subsystem that communicates with biometric sensor 108 and the latch subsystem to release shackle 102 as described above in the event of a release condition. The internal processor-readable memory is configured to store one or more fingerprint records, with each fingerprint record comprising authorized fingerprint data associated with a respective fingerprint identifier. Depending on the implementation or needs of a system, the fingerprint identifier may be generated anew by an external device and provided to padlock device 100 for creating a new fingerprint record or may be generated by padlock device 100 when padlock device 100 is instructed to create a new fingerprint record. For example, for larger enterprises, it may be useful to have centralized creation of fingerprint identifiers so that individual padlock devices 100 for the enterprise do not carry duplicate fingerprint identifiers that in fact are associated in different padlock devices 100 with different fingerprints.

Processing structure 135 is configured to receive sensed fingerprint data from the biometric sensor 108 and to cause the latch subsystem to release shackle 102 when the release condition is satisfied. In this embodiment, the release condition requires at least that the sensed fingerprint data corresponds to authorized fingerprint data in at least one of the fingerprint records, thus enabling an authorized person to open shackle 102 simply by touching the biometric sensor 108 with his or her finger. In an embodiment, the release condition may require additionally, for example, that the sensed fingerprint data is sensed by the biometric sensor at a time that corresponds to one or more authorized time windows for the corresponding fingerprint record. The authorized time windows can additionally be stored in associated with at least one of the fingerprint records in the internal processor-readable memory. This would enable padlock device 100 to remain locked outside of certain time windows to people who, within the time windows, would otherwise be able to unlock padlock device 100. In embodiments where padlock device 100 does not track time, such time-window functionality may be provided only to those using a software application on an external device to unlock padlock device 100, or not at all. As another example, the release condition may require that additional sensed fingerprint data be sensed by biometric sensor 108 (that is, more than one person's fingerprint, sequentially) and that the additional sensed fingerprint data corresponds to authorized fingerprint data in at least one other of the fingerprint records. This would enable padlock device 100 to require two different people (or at least two different fingerprints) to be present to unlock padlock device 100.

Processing structure 135 of padlock device 100, in this embodiment the first microprocessor, is also configured to present a management interface accessible by an external device that is in authorized communication with the control system. In this embodiment, the management interface presents software function calls available to be called by an external device that is authorized to communicate with padlock device 100. The function calls available to the external device enable the external device to instruct padlock device 100 to enroll a new fingerprint, delete or disable a fingerprint, provide access history, unlock padlock device 100, and the like. By providing such function calls, the external device can make changes on and can request information of padlock device 100 without having to know precise implementation details of padlock device 100. That is, the external device does not have to know how internal processor-readable memory is managed on padlock device 100, nor the instruction set for processing structure 135. Using management interface according to this embodiment, external device can selectively instruct processing structure 135 to store one or more fingerprint records in the internal processor-readable memory and/or to instruct processing structure 135 to delete or disable one or more stored fingerprint records in the internal processor-readable memory based at least on one or more respective fingerprint identifiers provided by the external device.

In this embodiment, the first microprocessor, serving as the master controller of padlock device 100, communicates with the external device, and also controls the second microprocessor, movement of motor 162, power management and alternative methods of unlocking padlock device 100 such as via the management interface as will be described or via a pattern of button presses as will also be described. The second microprocessor is used primarily for fingerprint related processes such as capturing fingerprint data from biometric sensor 108, retrieving fingerprint data from internal processor-readable memory, and signalling the first microprocessor in the event of matches or no matches, etc.

In this embodiment, processing structure 135 is also configured to present the management interface accessible by the external device in authorized communication with the control system to selectively instruct processing structure 135 to cause the latch subsystem to release shackle 102 without the control subsystem being in the release condition (that is, without having to have a finger presented to biometric sensor 108). This enables padlock device 100 to be unlocked by an authorized person having possession and control over the external device.

In this embodiment, such an external device could be a mobile device 800 provisioned to conduct authorized communications with padlock device 100, present a user interface, and to provide padlock device management functionality to a user of the mobile device 800 thereby to enable the user to be a manager of padlock device 100. A mobile device 800 is convenient to carry and can provide a convenient interface for managing access to padlock device 100. Such a mobile device 800 can be provisioned by downloading to mobile device 800 an executable software application (computer program) from, for example, an "App Store" server site such as is provided by Apple Computer of Cupertino, Calif., U.S.A., and installing the software application so that it may function on mobile device 800. The software application includes program code for authenticating a user who is an authorized manager of padlock device 100 on mobile device 800, and program code for presenting a user interface on mobile device 800 for enabling the authorized manager to conduct managing of fingerprint records for padlock device 100. The software application also include program code for accessing the management interface of padlock device 100 to selectively instruct the processing structure 135 of padlock device 100 in accordance with the managing.

In this embodiment, the software application also includes program code for causing mobile device 800 to retrieve a serial number of padlock device 100 from a remote server in the event that the authorized manager is authenticated. The software application also includes program code for sending the retrieved serial number and a user key corresponding to the authorized manager to padlock device 100 thereby to request padlock device 100 to authorize communications with the mobile device 800 thereby to enable mobile device 800 to instruct padlock device 100 via its management interface as described above.

Figure 8:
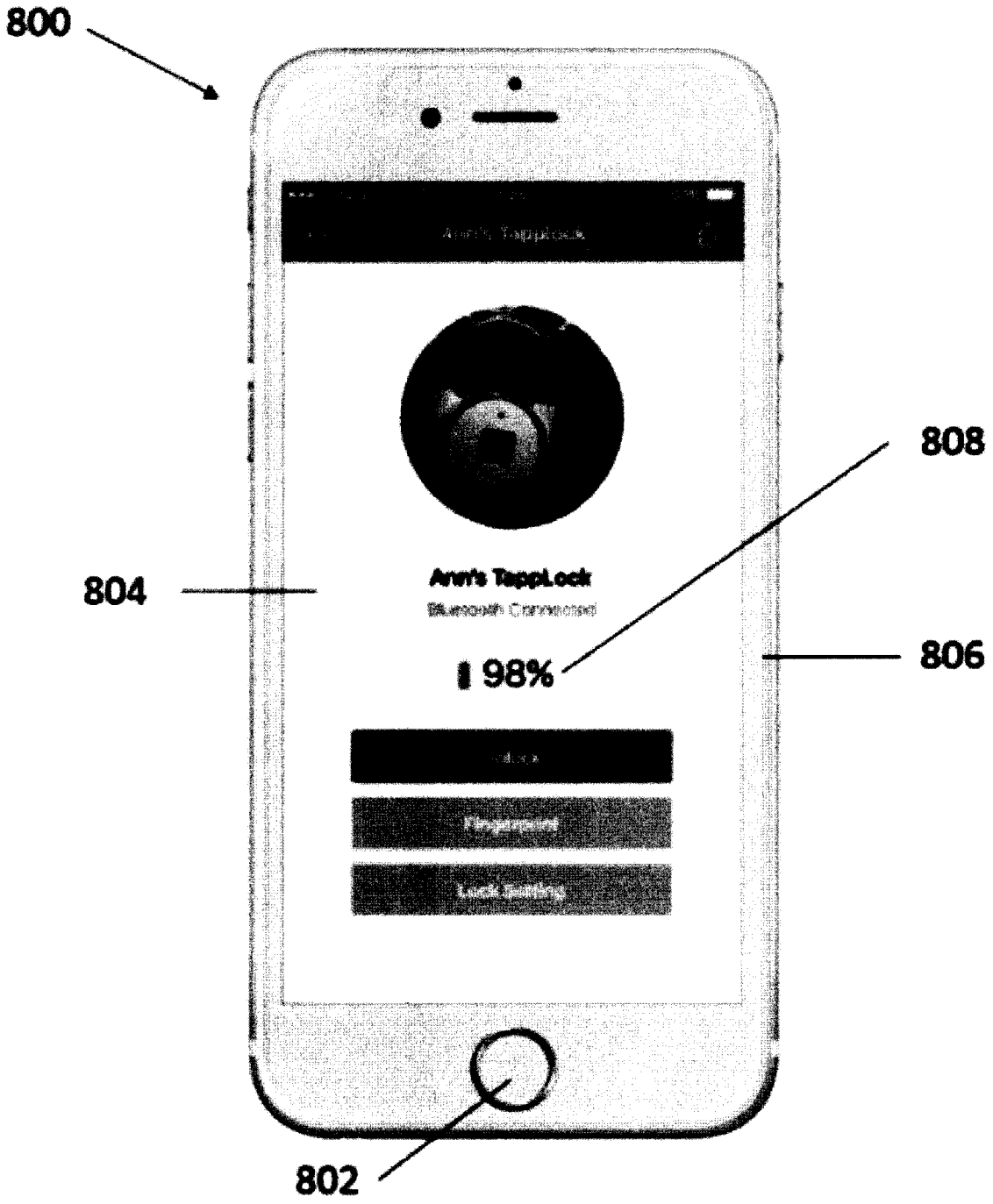
FIG. 8 is a front view of a mobile device displaying a user interface of a software application for communicating with the padlock device, according to an embodiment.

In this embodiment, mobile device 800 is a smartphone. FIG. 8 is a front view of a smartphone 800 displaying a user interface of a software application for communicating with padlock device 100, according to an embodiment. In this embodiment, smartphone 800 incorporates a biometric sensor 802, though in alternative embodiments a smartphone or other mobile device may be communicatively coupled to a biometric sensor rather than having a biometric sensor integrated within smartphone 800, or may have no biometric sensor whatsoever. In this embodiment, smartphone 800 also comprises a display 804 capable of displaying a user interface of a software application for communicating with padlock device 100 to a user. Display 804 also displays a battery power indicator 808 for padlock device 100 to which it is paired. In this embodiment, smartphone 800 incorporates a touchscreen 806 for accepting touch inputs from a user. In this embodiment, smartphone 800 incorporates a cellular transceiver, a Wi-Fi transceiver, and a Bluetooth transceiver to allow for communication with various other devices in various situations.

Initializing Padlock Device

Figure 9:
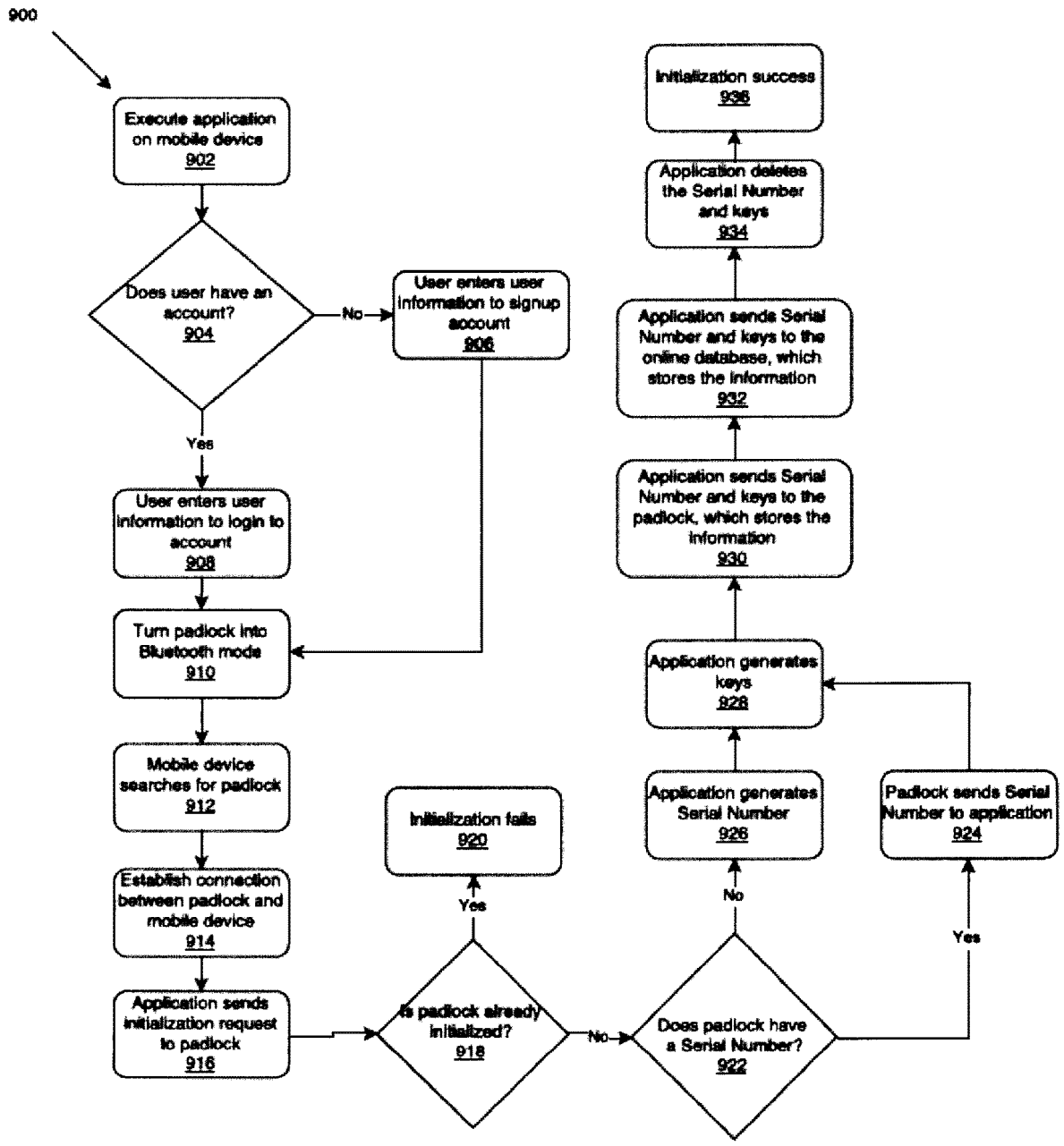
FIG. 9 is a flow chart showing steps in a method of initializing the padlock device using the software application.

In this embodiment, before padlock device 100 can be locked and unlocked, padlock device 100 must first be initialized to be associated with a user account. In this embodiment, this initialization process is called "first-pair". FIG. 9 is a flow chart showing steps in a method of initializing padlock device 100 using the software application. When the software application is executed on smartphone 800 at step 902 for the first time, the software application will proceed to step 904 to verify if the user has an account or not. If the user does not have an existing account the software application will proceed to step 906 and prompt the user to register an account with basic information relating to the user (e.g. one or more of a username, email address, password, name, physical address, security questions, or the like). If the user already has an account, the software application will proceed to step 908 and prompt the user to login to an existing account with information provided during registration. In this embodiment, the account information is stored in an online database on a remote server.

Figure 20:
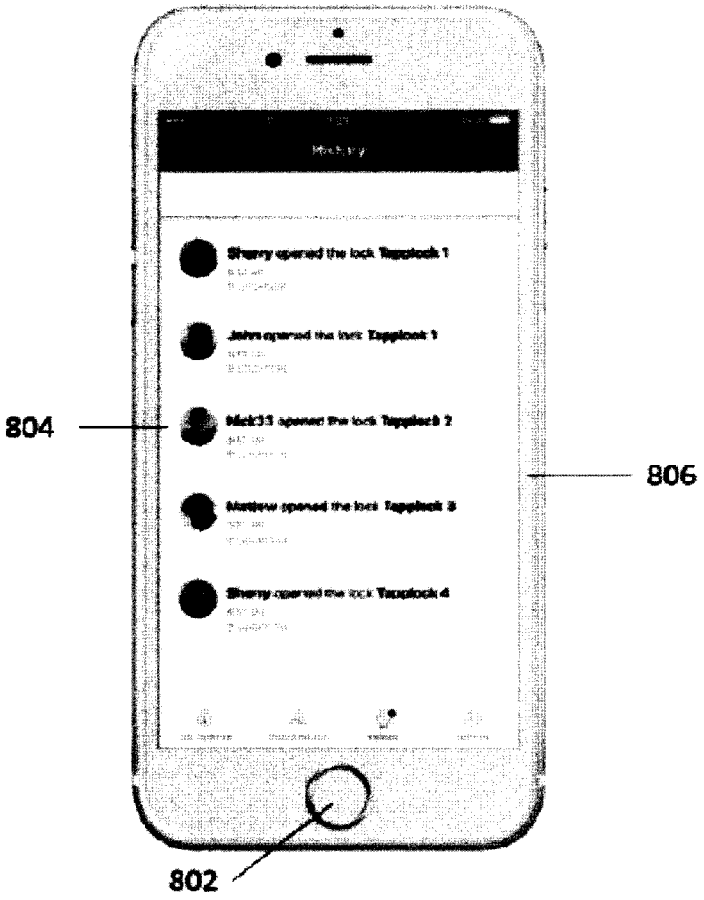
FIG. 20 is a front view of a mobile device displaying a user interface of a software application for showing a list of fingerprints unlock history.
Figure 20A:
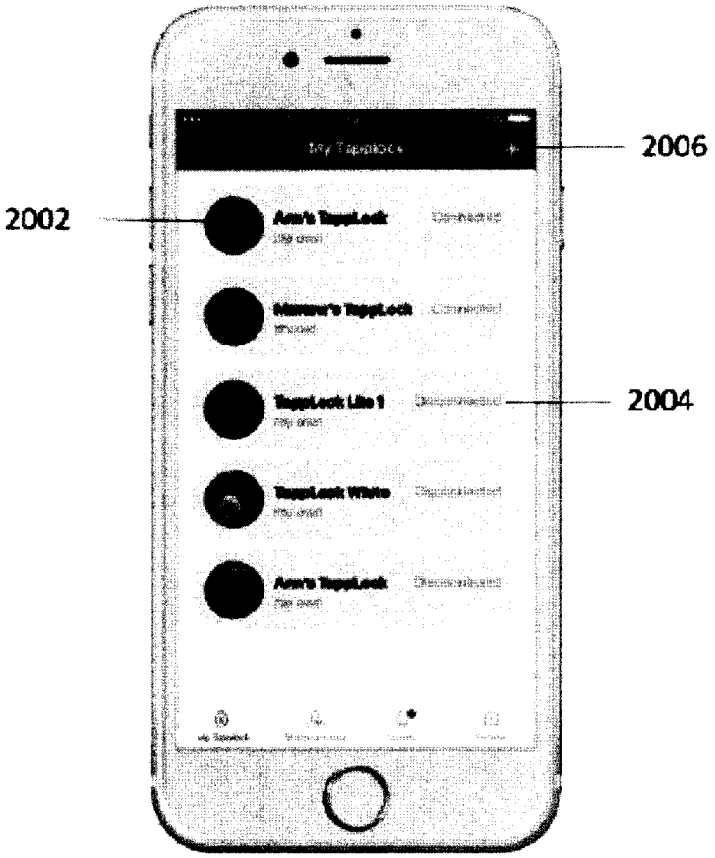
FIG. 20A is a front view of a mobile device displaying a user interface for a software application listing multiple padlock devices registered to an owner account.

In this embodiment, padlock device 100 can be awakened from sleep mode by pressing power button 116 once and can be switched into a Bluetooth mode by pressing power button 116 a second time (step 910), wherein the Bluetooth transceiver is in a condition to pair and communicate with, for example, smartphone 800. Upon pressing the "add padlock" symbol 2006 in the software application as shown in FIG. 20A (a front view of a mobile device 800 displaying a user interface for a software application listing multiple padlock devices 100 registered to an owner account), smartphone 800 will search for the nearby padlock device 100 via Bluetooth by using a device UUID that is pre-configured in padlock device 100 during production (step 912); the device UUID is a pre-defined identifier to help the software application find padlock device 100 during Bluetooth scans; once smartphone 800 finds padlock device 100 via Bluetooth, a connection (for example, a Bluetooth connection) is then established between padlock device 100 and smartphone 800 at step 914. The software application then sends an initialization request with a master password, which is also pre-configured and stored in padlock device 100 during production, to padlock device 100 (step 916). A master password is a secret identification code for padlock device 100 to recognize an authorized software application installed in the mobile device 800. At step 918, upon receiving the initialization request with the correct master password, padlock device 100 searches its memory to see if it has already been initialized and associated with an owner account; if so, padlock device 100 sends an initialization fail signal to the software application, ending the initialization process (step 920). On the other hand, if padlock device 100 is not already initialized, processing structure 135 of padlock device 100 and internal processor-readable memory then proceeds to booting. Padlock device 100 then checks to see if a Serial Number (SN)—essentially an unique lock ID—has already been stored (step 922). In this embodiment, once a SN has been assigned to a padlock device 100, it would be permanently stored in the internal processor-readable memory of padlock device 100; even if padlock device 100 is to be deleted or factory reset, allowing a previously initialized padlock device 100 to be initialized again and associated with a different owner account without changing the SN; the SN may then be used to track padlock devices in events of changes of ownership. If an SN number has already been stored in padlock device 100, padlock device 100 sends the stored SN to the software application to be used (step 924). If an SN number has not been assigned to padlock device 100, then the software application generates a unique SN to be used at step 926.

In this embodiment, the SN is generated using a unique string generation algorithm, such as an algorithm known in the art. It is to be noted that in some embodiments, the SN may also be generated by getting a sequentially unused ID from the online database and encrypting it, and in these cases publicly available cryptographic algorithms like MD5, SHA-1 or SHA-256 may be used for the encryption. At step 928, the software application then generates two random keys (hereby called key1 and key2) using a random string generation algorithm, such as an algorithm known in the art. The software application then sends the SN, key1 and key2 to padlock device 100, which stores the received information in the internal processor-readable memory of padlock device 100 (step 930); the software application then sends the SN, key1, key2 and padlock device 100's relevant information (like mac address, firmware version, etc.) to the online database to be stored (step 932); in the online database, the padlock device 100 and key1 (the key for owner level permissions) are associated with the user account; at step 934, the software application deletes the SN, key1 and key2 from the mobile device 800. Initialization is successful and the user account is then considered to be an owner account for padlock device 100 (step 936). It should be noted that in some embodiments, there may be multiple owner accounts for padlock device 100, and each owner account may have different permission levels that allow for different settings to be changed under that owner account; multiple keys would be generated and associated with different accounts to distinguish the permission levels. In some embodiments, an owner account may have multiple padlock devices 100 associated with the account.

It should be noted that the use of keys (for example, key1 and key2 as mentioned above) are used along with the SN as a security measure to prevent the SN from being illegally listened to, recorded and used to gain illegal access to padlock device 100. It should also be noted that in some embodiments, key1 and key2 may be updated with newly generated strings each time the owner is authenticated and the software application connects to padlock device 100; this further improves the security of the system by preventing one key to be used multiple times.

Authentication

According to some embodiments, authentication is required before any management such as changes in settings by an authorized owner/manager can be made to any of padlock devices 100 registered to an account. For example, if the owner wishes to share access of a padlock device 100 with a user that is not the owner (e.g. a third party), to add additional authorized digital fingerprints to the local memory on padlock device 100, or to remove a digital fingerprint from padlock device 100, these actions would all require owner authentication. It should be appreciated that some embodiments of the invention function without a non-owner's information being stored on the local memory of padlock device 100. However, in other embodiments, the owner can choose to add another user's (e.g. an individual who is not the owner) fingerprint in a digital format to the local memory on padlock device 100 such that padlock device 100 can be used by that non-owner user with a fingerprint, and without the use of a smartphone.

Figure 10:
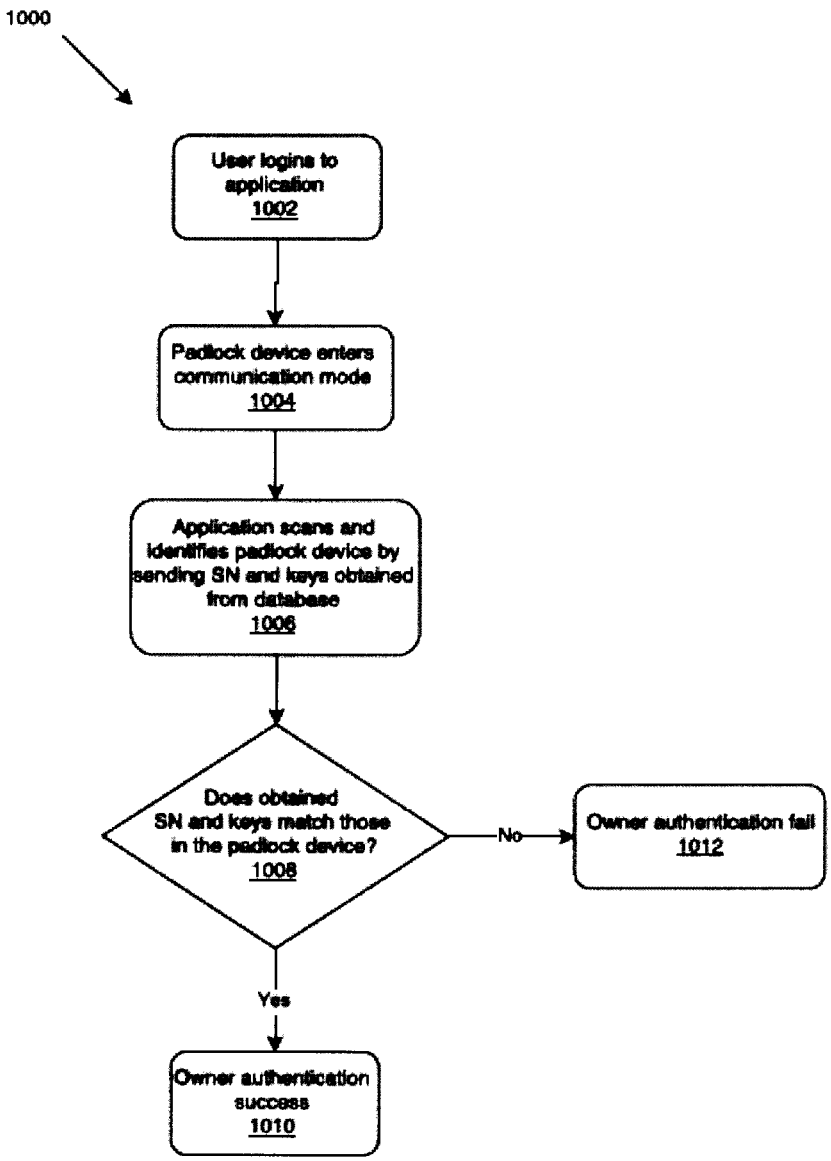
FIG. 10 is a flow chart showing steps in a method of authenticating a user of the software application with the padlock device.

FIG. 10 is a flow chart showing steps in a method 1000 of authenticating a user of the software application with padlock device 100. In some embodiments, two keys are stored in padlock device 100: key1 is used as a permission indicator for an owner, while key2 is used as a permission indicator for a shared user. Owner authentication may be performed through the software application on smartphone 800 via an online database by comparing a key associated with the user in the database with the key1 stored in the padlock device during initialization. At step 1002, the software application will prompt the user to login using credentials (e.g. one or more of a username, email address, password, or the like) provided during registration. When the user is successfully logged in, padlock device 100 may communicate with mobile device 800 by pressing power button 116 twice and turning on the padlock's Bluetooth mode (step 1004). The software application automatically scans in the vicinity of mobile device 800 for any padlock devices 100 with the pre-configured Bluetooth UUID stored in the padlock device 100 during production. The software application identifies a padlock device 100 by its mac address and retrieves the associated SN and the user's key previously stored during initialization from the online database.

The software application sends the SN and key to padlock device 100 (step 1006). At step 1008, software application compares information obtained from database with those in padlock device 100. If the SN matches to that stored in padlock device 100 and the user's key matches key1 stored in padlock device 100, then the owner authentication is successful and owner permissions is established (step 1010). If not, the method proceeds to step 1012 and authentication fail.

Alternative Authentication

In this embodiment, if the owner is within proximity of padlock device 100, the user can be authenticated by retrieving and using the encrypted owner identifier stored in the local memory of padlock device 100 (rather than matching lock ids stored in padlock device 100 and the online database). This owner identifier can then be compared to an owner identifier computed from the fingerprint provided by the user attempting to obtain authorization. According to some embodiments, only the owner is allowed to authenticate using the data stored locally on padlock device 100.

Figure 11:
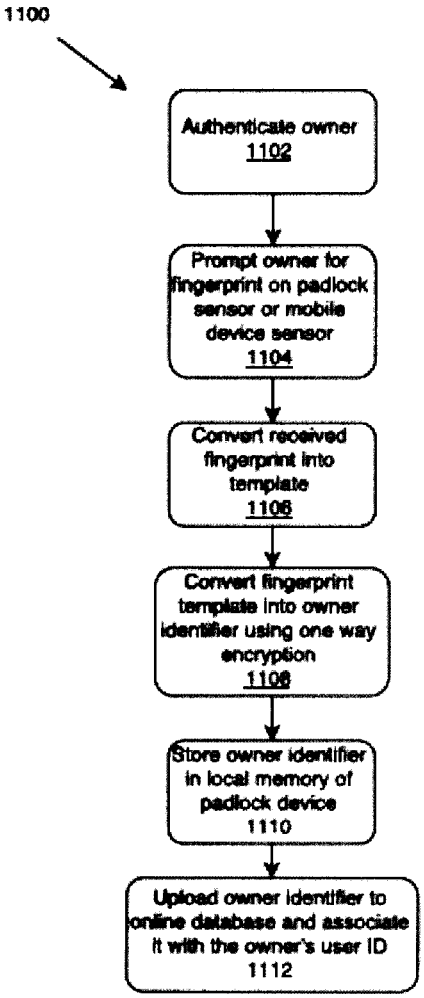
FIG. 11 is a flow chart showing steps in an alternative method of authenticating a user of the software application with the padlock device.

FIG. 11 is a flow chart showing steps in an alternative method 1100 of authenticating a user of the software application with padlock device 100. When the owner has been successfully authenticated (step 1102), the software application on mobile device 800 will prompt the owner to scan the fingerprint on either mobile device biometric sensor 802 or padlock device biometric sensor 108 (step 1104). In some embodiments, the fingerprint is provided via a separate biometric sensor device which is communicatively coupled to mobile device 800. The received fingerprint is then converted into a fingerprint template using techniques known in the art (step 1106). The template is then converted into an owner identifier via one-way encryption (step 1108). In some embodiments, publicly available cryptographic algorithms like MD5, SHA-1 or SHA-256 may be used for the one-way encryption. The owner identifier is then stored in the internal processor-readable memory of padlock device 100 (step 1110). Finally, the owner identifier is uploaded to an online database where the owner identifier is associated with the owner's account (for example, via the account's user ID) and stored (step 1112).

Figure 12:
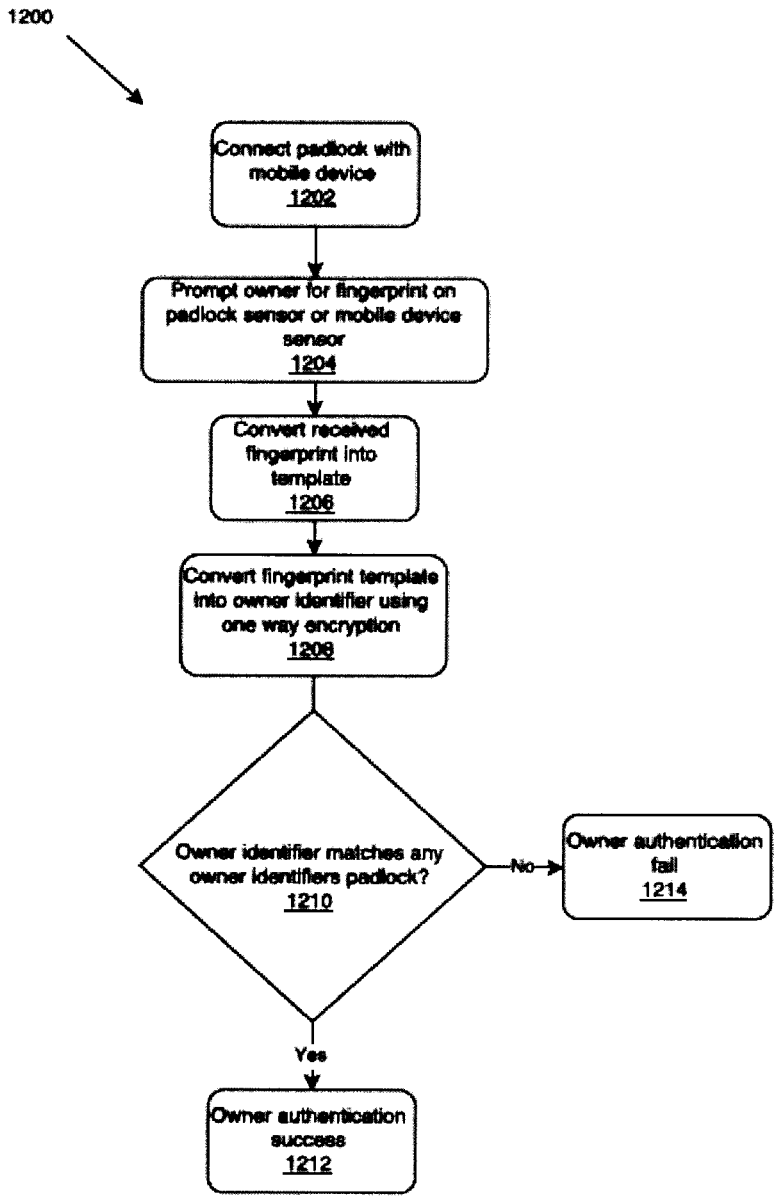
FIG. 12 is a flow chart showing steps in a method of authenticating using a fingerprint.

FIG. 12 is a flow chart showing steps in a method 1200 of authenticating using a fingerprint. In this embodiment, padlock device 100 is connected to mobile device 800 by pressing power button 116 twice and turning on the connection mode. A connection (in this embodiment, a Bluetooth connection) is then established between padlock device 100 and mobile device 800 (step 1202). The software application then prompts the owner to scan the fingerprint on either mobile device biometric sensor 802 or padlock device biometric sensor 108 (step 1204). In some embodiments, the fingerprint is provided via biometric sensor 802. In some embodiments, the fingerprint is provided via a separate biometric sensor device which is communicatively coupled to mobile device 800. The received fingerprint is then converted into a fingerprint template using techniques known in the art (step 1206). The template is then converted into an owner identifier via one way encryption (step 1208). In some embodiments, publicly available cryptographic algorithms like MD5, SHA-1 or SHA-256 may be used for the one-way encryption. The newly converted owner identifier is then compared with the owner identifier stored in padlock device 100 (step 1210). If the owner identifiers match, then the owner authentication is successful (step 1212). If no matches are found, the owner authentication fails (step 1214) and all subsequent actions contingent upon owner authentication is to be denied.

User Profiles

Figure 13:
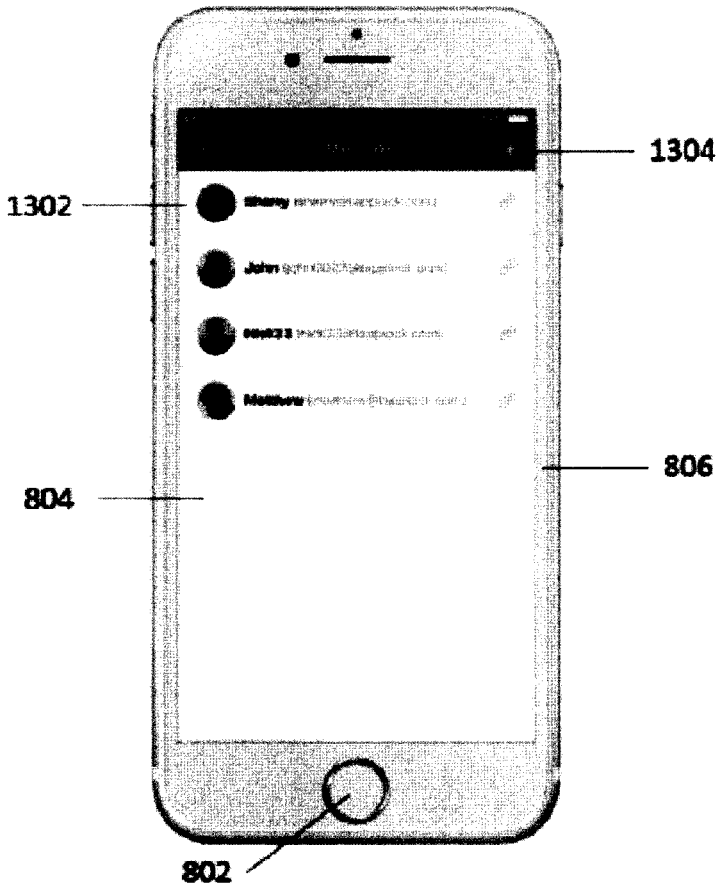
FIG. 13 is a front view of a mobile device displaying a user interface of a software application showing a list of the individual users with access privileges for the padlock device.
Figure 13A:
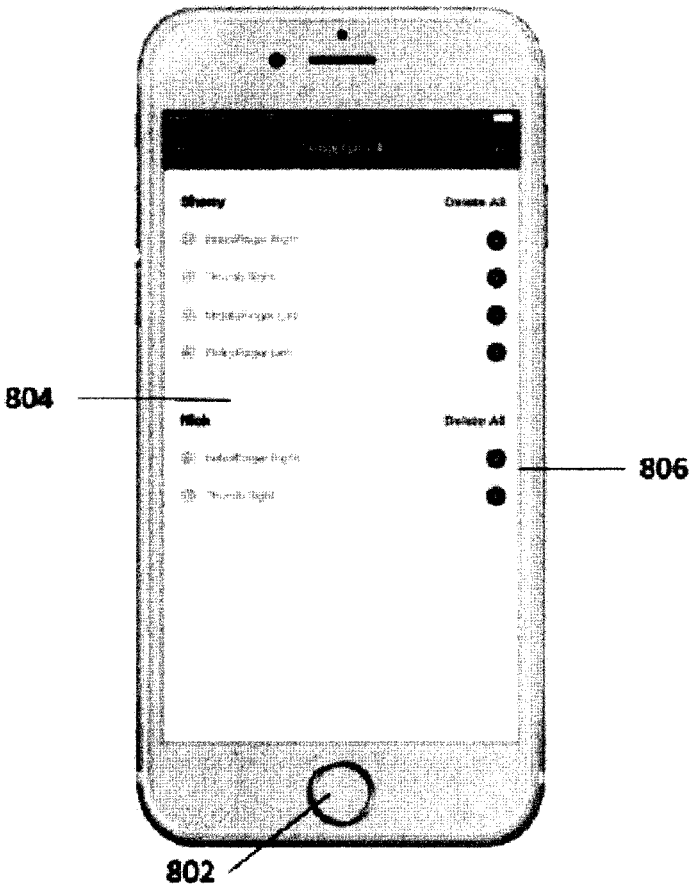
FIG. 13A is a front view of a mobile device displaying a user interface of a software application showing a list of fingerprints under one or more user profiles.

In some embodiments, the software application may allow the owner to manage fingerprints according to users' individual identities, or user profiles. FIG. 13 is a front view of a mobile device 800 displaying a user interface of a software application showing a list of the individual users with access privileges for padlock device 100. As shown in FIG. 13, once registered, a list of the user profiles 1302 with privileges to access padlock device 100 is displayed to the owner in the software application. The owner may also associate additional users with padlock device 100 via the software application, for example, by pressing a button 1304 on the touchscreen of smartphone 800. FIG. 13A is a front view of a mobile device 800 displaying a user interface of a software application showing a list of fingerprints under one or more user profiles. As shown in FIG. 13A, data pertaining to more than one fingerprint from the same user may be managed and/or stored in the online database. In some embodiments, the internal processor-readable memory on padlock device 100 may store data pertaining to more than one fingerprint for different fingerprints from the same user. It should be noted that organizing the fingerprint data according to a hierarchical structure based on user, rather than on fingerprint, allows for more efficient modification of access privileges. For example, simply deleting the user would delete all of the fingerprints associated with that user, rather than having to delete each fingerprint of that user individually.

Registering Fingerprint

In this embodiment, the owner enables padlock device 100 to enter a mode of operation in which padlock device 100 can accept a fingerprint of a user for storage within the local memory of padlock device 100 as a user authorized to unlock padlock device 100. Once in the "accept" mode of operation, the user can scan a fingerprint into padlock device 100 via sensor 108, and a digital fingerprint template corresponding to fingerprint is then stored in a fingerprint record in internal processor-readable memory on padlock device 100 in association with a fingerprint ID unique to the finger that was scanned. In this embodiment, only the owner has the privileges required to enable padlock device 100 to accept a fingerprint for digitization and local storage within the local memory of padlock device 100.

Figure 14:
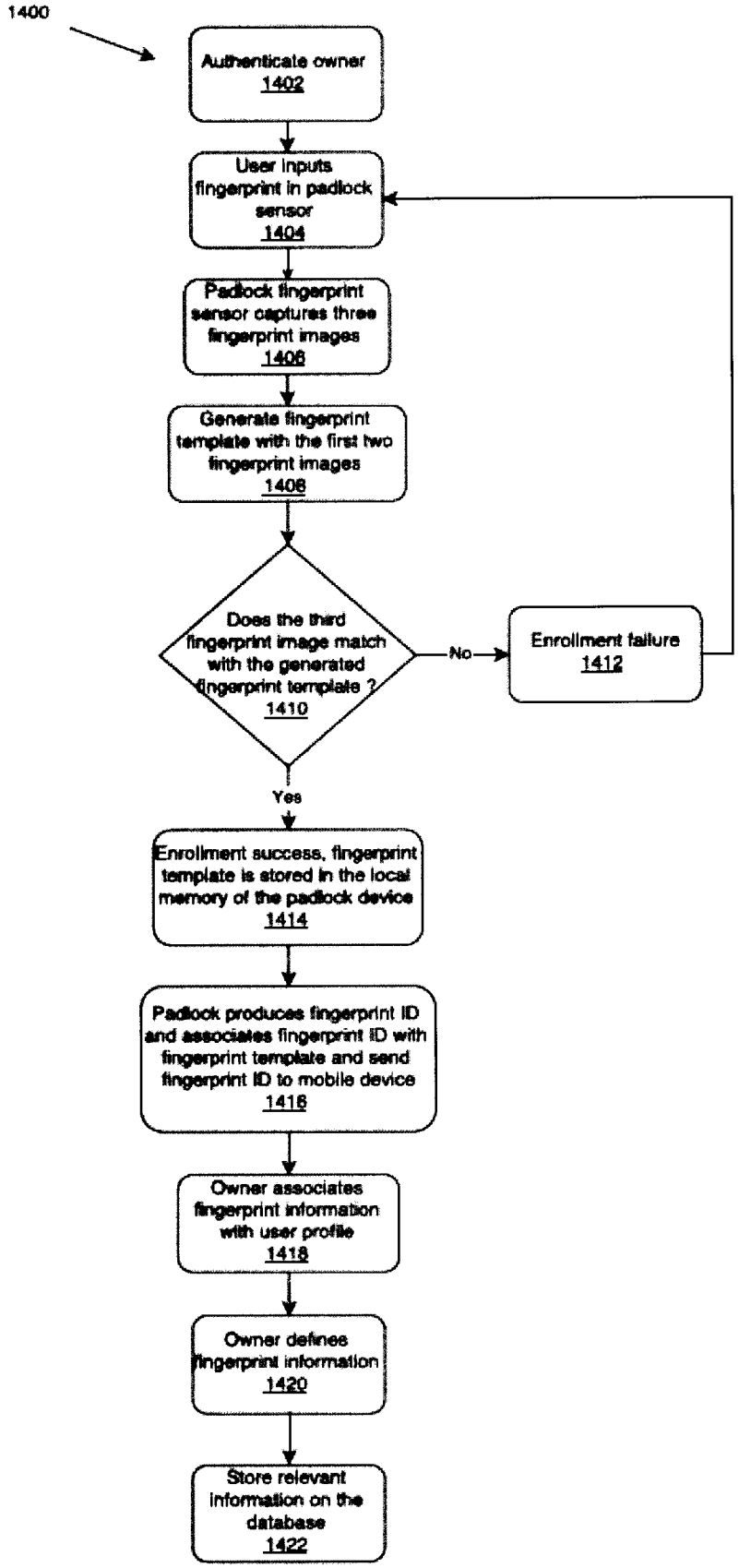
FIG. 14 is a flow chart showing steps in a method of registering a fingerprint for use with a padlock device according to an embodiment.

FIG. 14 is a flow chart showing steps in a method 1400 of registering, or "enrolling", a fingerprint for use with a padlock device 100 that has already been initialized by the owner, according to an embodiment. It is to be noted that the fingerprint being registered may belong to a non-owner user or the owner itself. In this embodiment, at step 1402, the owner is required to be authenticated by the software application (as described in FIG. 11) and confirmed as the owner of padlock device 100 before padlock device 100 accepts the user's fingerprint. In this embodiment, when the owner authentication is successful, the owner may send an enroll fingerprint command to padlock device 100 via the software application. Padlock device 100 wakes up biometric sensor 108; the user is then able to enroll a fingerprint via biometric sensor 108 at step 1404. Once biometric sensor 108 senses a touch of finger, it (in coordination with the second microprocessor of processing structure 135 handling fingerprint data tasks) takes three consecutive capacitive touch images of the fingerprint (step 1406) to gather sensed fingerprint data. The first two images are used to generate a fingerprint template, which is then stored by the second microprocessor of processing structure 135 as a fingerprint record in the template library within the memory of padlock device 100 in association with a fingerprint identifier (step 1408). The third image is then used to verify the template (step 1410). If the third image fails to match with the generated fingerprint template, the enrollment process fails (step 1412); the fingerprint template and fingerprint images are deleted from padlock device 100, and the user is prompted to try again. If the third image matches with the generated fingerprint template, then the enrollment is successful (step 1414); the fingerprint images are deleted from padlock device 100 while the generated fingerprint template is kept.

In this embodiment, padlock device 100 produces a sequentially new fingerprint identifier for the fingerprint to be used as the fingerprint identifier. The fingerprint identifier is associated with the fingerprint template in the internal processor-readable memory of padlock device 100 and also sent to the mobile device 800 (step 1416). The software application then allows the owner to choose the user whose fingerprint was just accepted from a list of user profiles (step 1418). If the user does not exist in the list of user profiles, the owner is asked to enter basic information (e.g. one or more of a username, email address, name, or the like) about the user and create a user profile for the user. If the user has an existing user profile, that user profile will be used. Once the user profile has been selected or created, the owner then selects which finger the accepted fingerprint belongs to at step 1420. In this embodiment, the fingerprint identifier, user profile, finger selected, owner' account and all relevant information are associated with each other and uploaded to the online database at the remote server, to be stored at step 1422.

Operating Padlock Device

Figure 15:
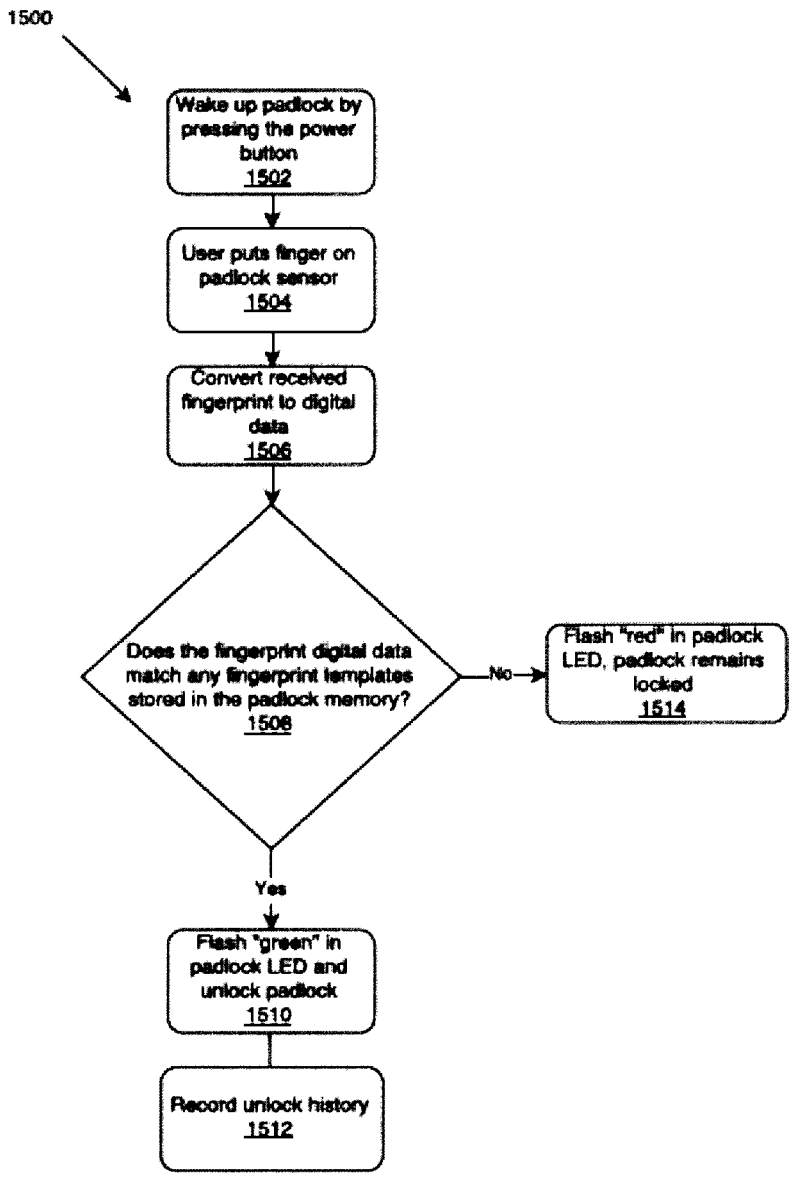
FIG. 15 is a flow chart showing steps in a method of operating the padlock device according to an embodiment.

In this embodiment, padlock device 100 can be unlocked via the software application on smartphone 800 or via biometric sensor 108 on padlock device 100 itself. FIG. 15 is a flow chart showing steps in a method 1500 of operating padlock device 100 according to an embodiment. At step 1502, power button 116 of locked padlock device 100 is pressed. This serves to awaken padlock device 100 if in sleep mode. At step 1504, the user presses a finger against biometric sensor 108 on padlock device 100; this wakes up biometric sensor 108. It will be appreciate that the user must use a finger for which a fingerprint was previously stored in the local memory of padlock device 100 to successfully unlock padlock device 100. At step 1506, the biometric sensor 108 receives the fingerprint and converts the received fingerprint to digital data using techniques known in the art. At step 1510, the second microprocessor of processing structure 135 in padlock device 100 compares the fingerprint digital data with fingerprint templates (including that of the owner) stored in the local memory on device 100.

It should be noted that in some embodiments, the comparing and matching process may be done in other components or devices (for example the fingerprint module or the mobile device). In this embodiment, if the received fingerprint corresponds to—that is, matches—one of the fingerprint templates stored in the local memory, then the release condition is achieved and the lock should be unlocked. In an embodiment, this newly received fingerprint is also used to enrich the current template; this enriching process, called adaptive fingerprint learning, increases the accuracy and performance of the fingerprint scanning process every time an authorized fingerprint is scanned. With the second microprocessor of processing structure 135 having recognized that the sensed fingerprint data corresponds to fingerprint data in a fingerprint record in internal processor-readable memory, the second microprocessor signals the first microprocessor. The first microprocessor can determine if any other conditions needs satisfying before considering the release condition to have been fully satisfied and, if the release condition is indeed fully satisfied, the first microprocessor of processing structure 135 causes the latch subsystem to move to an unlock condition by causing motor 162 to release latches 155 to allow shackle 102 to be ejected from channel 132 and 154 (step 1510); in some embodiments, LED signal 110 is driven by the first microprocessor of processing structure 135 to flash green. In this embodiment, padlock device 100 also creates and stores a history record in the internal processor-readable memory for the fingerprint identifier associated with the fingerprint (step 1512). In this embodiment, the set of history records keeps the sequence of successful accesses (i.e., each time the shackle is successfully released from its locked condition) in the history records. In this embodiment, the history record simply stores the fingerprint identifier used for successfully accesses, in sequence of access. In alternative embodiments, where padlock device 100 is capable of tracking date/time, a timestamp of date/time of the successful access may be included in the history record. In alternative embodiments, the history record may also include location information for the successful access in the event that padlock device 100 incorporates a global positioning system (GPS) receiver or is otherwise capable of discerning its physical location. For example, if padlock device 100 is positioned on the back door of a transport truck, it may be useful to log information about where in its travels (source, destination or somewhere in between) it had been successfully unlocked.

On the other hand, if at step 1508, the received fingerprint does not match any of the locally stored fingerprint templates, then padlock device 100 should not be unlocked, and motor 162 will not be actuated; in this embodiment, the LED signal 110 will flash red (step 1514). To prevent aggressive operations of the padlock, five consecutive failed attempts would lead to a shut-down of padlock device 100.

Deleting Fingerprints

Figure 16:
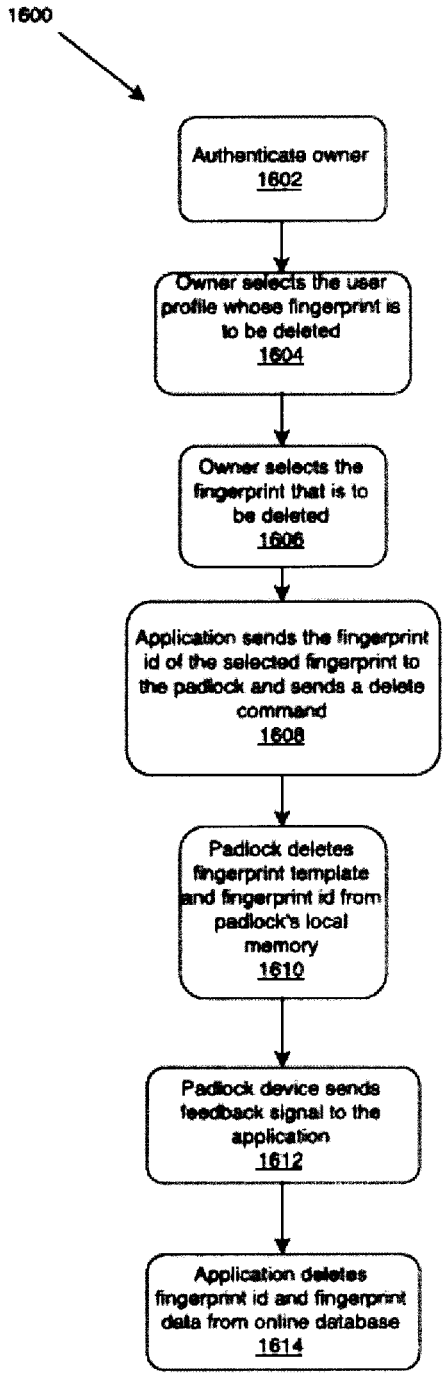
FIG. 16 is a flow chart showing steps in a method of deleting one or more fingerprints from the padlock device.

FIG. 16 is a flow chart showing steps in a method 1600 of deleting one or more fingerprints from padlock device 100. In this embodiment, the authorized manager/owner is able to view a list of user profiles and lists of fingerprints belonging to those user profiles stored in padlock device 100 (See FIGS. 13 and 13A). In this embodiment, an owner can manage and delete one or more specific fingerprints from padlock device 100, mobile device 800 or the online database at a remote server based on its fingerprint identifier.

After authenticating the owner (step 1602), the owner selects a user profile from a list of user profiles (step 1604); the owner then selects a fingerprint to delete from a list of fingerprints under the selected user profile (step 1606). At step 1608, the software application then sends the corresponding fingerprint identifier of the selected fingerprint as well as a delete command to the management interface of padlock device 100. At step 1610, padlock device 100 searches and deletes the fingerprint ID and fingerprint template associated with the fingerprint ID from the padlock's local memory. In an embodiment, padlock device 100 may search and disable the fingerprint identifier and fingerprint template associated with the fingerprint identifier from in the padlock's local memory. At step 1612, padlock device 100 sends a feedback signal to the software application to notify a successful delete action. Then the software application removes (or disables) the fingerprint identifier and fingerprint data (for example, which finger's fingerprint was deleted) from the online database at the remote server and updates the user interface to reflect the change at step 1614. The ability for an authorized owner/manager to delete individual fingerprints using the management interface is significantly more useful than having to clear all of the fingerprints from padlock device 100 should one employee no longer have access and thereafter having to reconstitute the set of authorized persons again.

Delete User Profile

Figure 17:
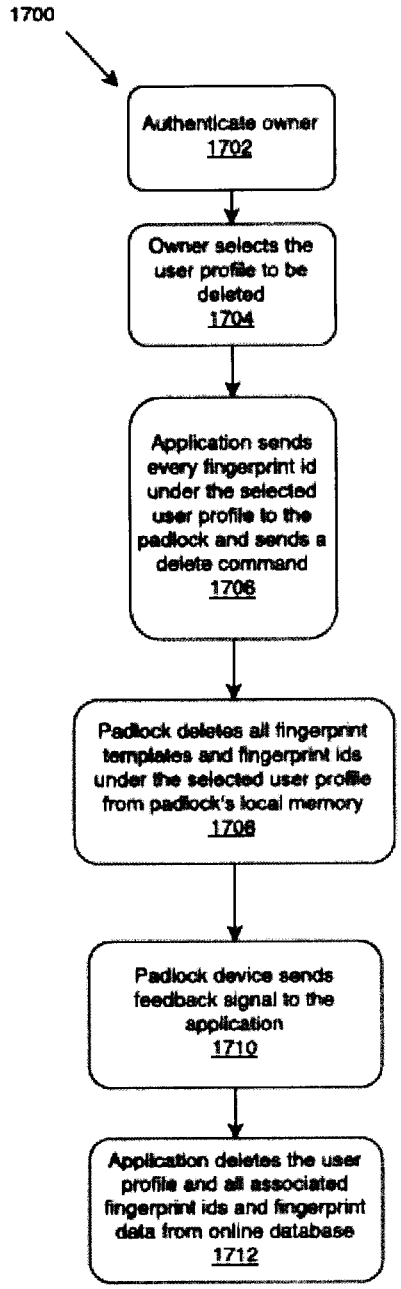
FIG. 17 is a flow chart showing steps in a method of deleting one or more user profiles from the software application.
Figure 18:
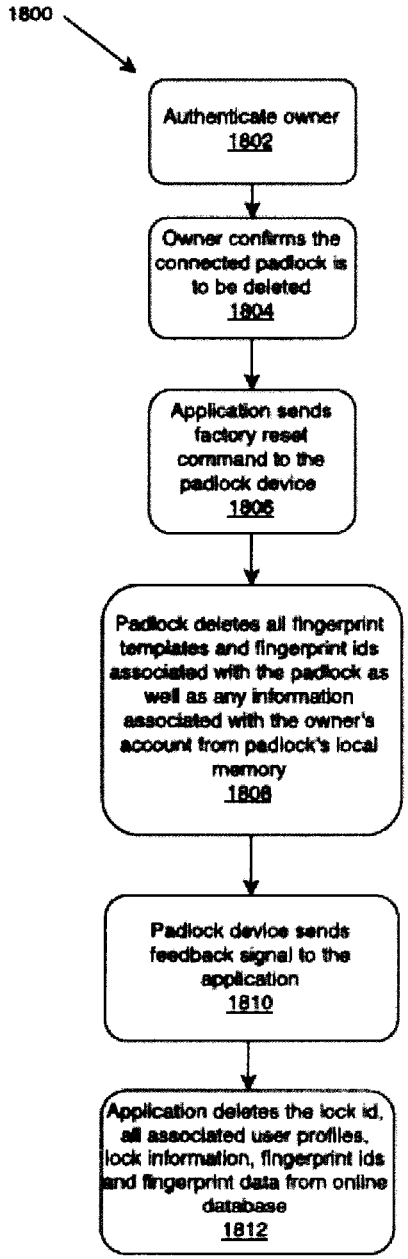
FIG. 18 is a flow chart showing steps in a method of resetting a padlock device completely.

In this embodiment, the owner can delete a user profile and all of the fingerprints registered under that user profile. FIG. 17 is a flow chart showing steps in a method 1700 of deleting one or more user profiles from the software application. After the owner has been successfully authenticated (step 1702), method 1700 proceeds to step 1704 where the owner selects the user profile to delete from a list of user profiles previously created for padlock device 100 (See FIG. 13, screenshot of list of user profiles). In this embodiment, the list of user profiles is retrieved from the online database. The software application then sends every fingerprint identifier under that user profile as well as a delete command to padlock device 100 (step 1706). Padlock device 100 searches and deletes the fingerprint IDs and fingerprint templates associated with each of the fingerprint IDs from the internal processor-readable memory of padlock device 100 (step 1708). Padlock device 100 sends a feedback signal to the software application to notify a successful delete action (Step 1710). Then the software application removes the fingerprint IDs and fingerprint data (for example, which finger's fingerprint was deleted) associated with each of the fingerprint IDs from the online database and updates the interface to reflect the change (step 1712). The ability for an authorized owner/manager to delete all of an individual users' individual fingerprints (should they have more than one) using the management interface is significantly more useful than having to clear all of the fingerprints from padlock device 100 should one employee no longer have access and thereafter having to reconstitute the set of authorized persons again.

Delete Padlock

In this embodiment, the owner can delete a padlock device 100 and all of the user profiles and fingerprints registered under that padlock device 100 from the owner account. In this embodiment, after a padlock device 100 is deleted from an owner account, padlock device 100 may then go through the initiation process (See FIG. 9) again to be registered to another owner account. After the owner has been successfully authenticated (step 1802), method 1800 proceeds to step 1804 where the owner selects the padlock device 100 to delete from the list of padlock devices 100 previously registered to the owner account (See FIG. 13, screenshot of list of locks registered under the owner account). In this embodiment, the list of padlock devices 100 is retrieved from the online database. In this embodiment, the list of padlock devices 100 is stored locally on the mobile device 800. The software application then sends a factory reset command to padlock device 100 (step 1806). Padlock device 100 deletes all fingerprint ID data, fingerprint templates, key1, key2, user related data and any additional information stored after the initiation process (other than information intended to remain, like SN, firmware updates, etc.) from the internal processor-readable memory of padlock device 100 (step 1808). Padlock device 100 sends a feedback signal to the software application to notify a successful delete action (Step 1810). Then the software application removes fingerprint IDs, fingerprint data (for example, which finger's fingerprint was deleted) and other information associated with the deleted padlock device 100 from the online database and updates the interface to reflect the change (step 1812).

Retrieve Access History

Figure 19:
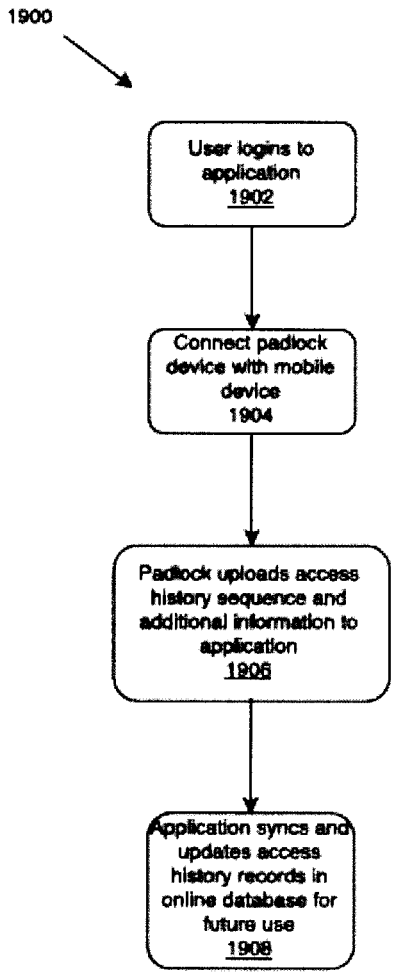
FIG. 19 is a flow chart showing steps in a method by which the software application retrieves access history stored on the padlock device.

In this embodiment, padlock device 100 may provide access history records to mobile device 800 to be displayed or used. The management interface of padlock device 100 allows mobile device 800, once authorized, to instruct the processing structure 135 of padlock device 100 to provide the history records, or at least a subset of them. FIG. 19 is a flow chart showing steps in a method 1900 by which the software application retrieves access history stored on padlock device 100. At step 1902, the software application will prompt the user to login using credentials (e.g. one or more of a username, email address, password, or the like) provided during registration. At step 1904, padlock device 100 is connected with and authorizes mobile device 800 in the way that demonstrated in method 1000. In this embodiment, padlock device 100 then sends all access history, including but not limited to fingerprint ID, access sequence, access timestamp, access location and information of the kind, to the software application (step 1906). In this embodiment, padlock device 100 only sends the access history information that has not been flagged as read. Each time the software application receives access history information, a log entry will be uploaded into the online database with a timestamp. The access records sent from padlock device 100 would also be flagged as read in padlock device 100. The software application then uploads the received information to the online database and updates existing records, if there are any (step 1908). In this embodiment, the fingerprint IDs from the retrieved access history may be matched with fingerprint IDs and associated user profiles and lock profiles in the online database and displayed to the owner in chronological order. FIG. 20 is a front view of mobile device 800 displaying a user interface of a software application for showing a list of fingerprints unlock access history.

Battery Information

In this embodiment, padlock device 100 may send battery (or batteries, or other power source) information, including but not limited to voltage, current, resistance, to mobile device 800. The management interface of padlock device 100 allows mobile device 800, once authorized, to instruct processing structure 135 of padlock device 100 to provide the battery information, or at least a subset of it. This information may then be used to calculate and produce information to improve user experience (for example, percentage of power source remaining 808 as shown in FIG. 8, power source conditions, potential hardware damage, and information of the like).

Access Privileges

In this embodiment, the software application allows for customized privileges for different users. In this embodiment, the customized privileges apply to users whose fingerprint data is not stored in the local memory of padlock device 100. For example, the owner may set the software application to only allow access privileges to certain users at certain times of the day or certain days of the week. For example, the owner may allow their friend to only unlock padlock device 100 on weekends. In this embodiment, the updating of access privileges requires authentication by the owner.

User Interface: Lock List

FIG. 20A illustrates an example embodiment of the user interface for the software application running on mobile device 800 when one or more devices are registered to an owner account. The owner is able to view a list 2002 of padlock devices 100 identified by name (which may be customized by the owner), the connection status 2004 of each padlock device 100 listed with the smartphone 800. By clicking one of the listed padlock device, the corresponding open/closed status can be shown.

Morse Code

Figure 21:
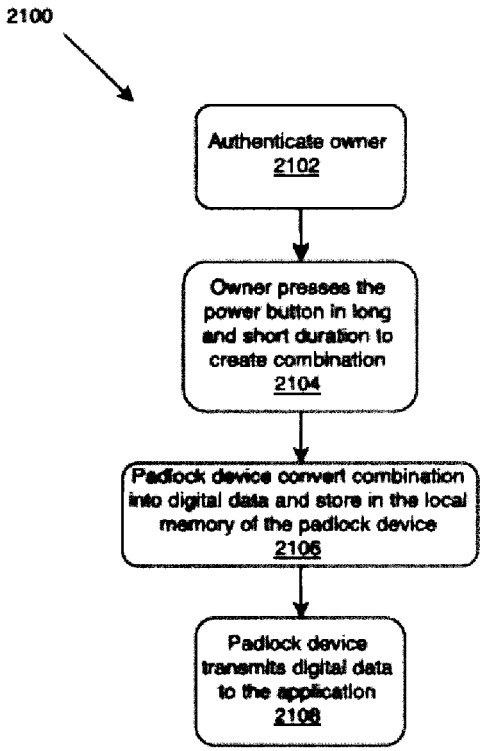
FIG. 21 is a flow chart showing steps in a method of setting up the Morse code with the use of the padlock device.

In this embodiment, padlock device 100 may be unlocked using a method called "Morse code", without having to use biometric sensors, keys, and external devices. FIG. 21 is a flow chart showing steps in a method 2100 of setting up the Morse code with the use of padlock device 100. After successfully authenticating the owner (step 2102), user can press power button 116 of padlock device 100 in long and/or short duration to create a combination (step 2114). In this embodiment, up to 10 digits code can be generated. At step 2116, padlock device 100 then converts the combination code into digital data and stores the digital data in the internal processor-readable memory of padlock device 100. Meanwhile, padlock device 100 stransfer the same digital data to the software application for the purpose of backup storage at step 2108.

Figure 21A:
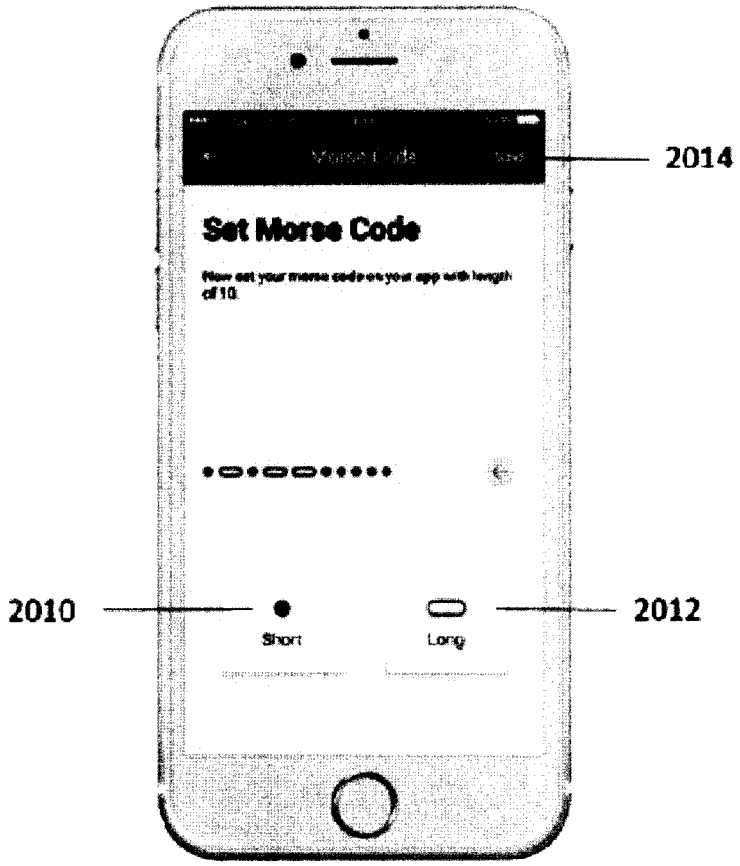
FIG. 21A is a front view of a mobile device displaying a user interface for a software application for setting up the Morse code.

FIG. 21A is a front view of mobile device 800 displaying a user interface for a software application for setting up the Morse code according to an alternative method. By pressing the button 2010 and button 2012 in a custom order, the software application will create a combination code. The owner presses the save button 2014, and the combination is converted into digital data. The digital data is then transmitted to padlock device 100 for storage via the management interface in the internal processor-readable memory of padlock device 100.

Figure 22:
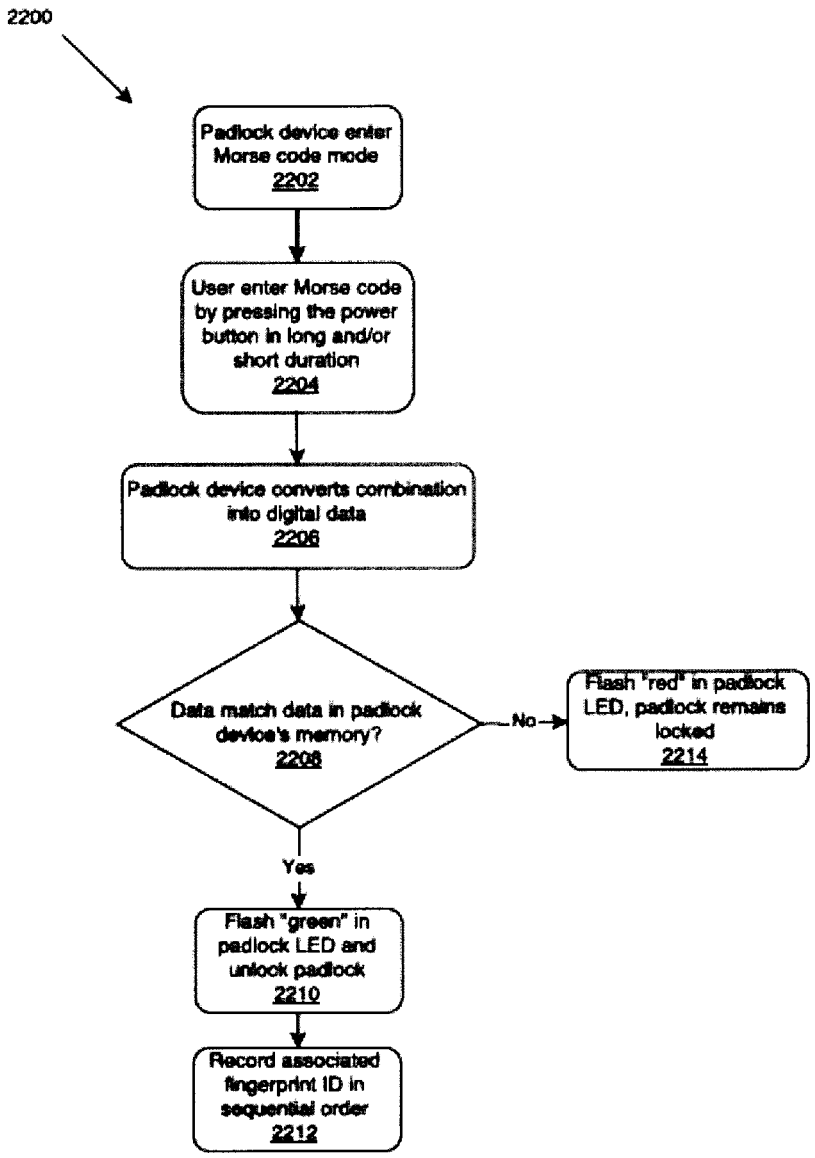
FIG. 22 is a flowchart showing steps in a method of unlocking the padlock using Morse code.

FIG. 22 is a flowchart showing steps in a method 2200 of unlocking padlock device 100 using Morse code. The user presses the power button 116 three times to shift padlock device 100 into Morse code mode (step 2202). In this embodiment, the user then presses power button 116 in a 10 digits custom combination of long and short durations (step 2204). The combination is converted into digital data (step 2206). The digital data is compared with the digital data stored in the internal processor-readable memory of padlock device 100 (step 2208); if the data matches, padlock device 100 is unlocked at step 2210. In this embodiment, processing structure 135 in padlock device 100 causes motor 162 to release latches 155 and allows shackle 102 to be ejected from channels 132, 154 (step 2210); in this embodiment, LED signal 110 will flash green; padlock device 100 then creates and adds a history record for the fingerprint ID associated with the fingerprint (step 2212). In this embodiment, the history record keeps the sequence of access in the history records. In this embodiment, the history record does not store the date/time timestamp of access, the history record simply being a sequential list of fingerprint identifiers in the order in which the successful accesses occurred. In alternative embodiments, where padlock device 100 is capable of tracking date/time, the history record could also store the date/time timestamp of access and, where padlock device 100 is capable of discerning its location, the location of the access. If at step 2214, the received fingerprint does not match any of the locally stored fingerprints, then padlock device 100 should not be unlocked, and motor 162 will not be actuated so padlock device 100 will not unlock; in an embodiment LED signal 110 flashes red.

Multi-Fingerprint Authentication

In this embodiment, the systems and methods disclosed herein use multilayer fingerprint authentication protocols in order to put padlock device 100 into a release condition. That is, in order to authenticate an account, fingerprints from more than one user may be required to be provided sequentially, possibly from multiple locations. For example, to unlock padlock device 100 according to some embodiments may require that more than one users provide a fingerprint. In an embodiment, such permission may be obtained by the software application sending an alert to each required user's mobile devices, prompting each user for a fingerprint authentication remotely from the padlock device sensor 802.

Security of Storage

It should be appreciated from examples in this document that in some embodiments, none of the identification data is stored locally on any mobile device 800. Any encrypted data is stored in an online database, and so the loss of mobile device 800 would not result in the security of the lock being compromised. Furthermore, since use of the software application on any mobile device requires authentication, the systems and methods described herein may provide a robust security system that is resistant to tampering.

Figure 23:
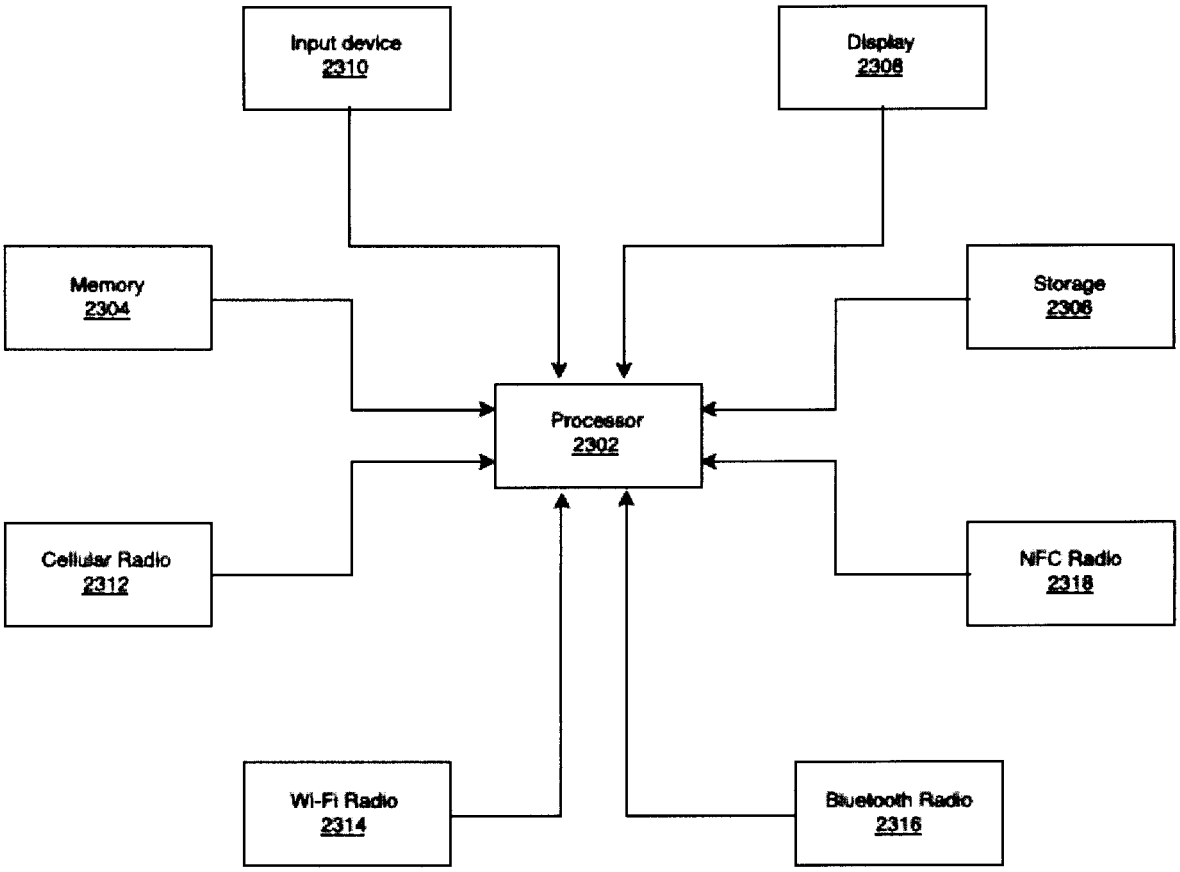
FIG. 23 is a schematic diagram of a mobile communication device, according to an embodiment.

FIG. 23 is a schematic diagram of a mobile communication device, according to an embodiment. As depicted, mobile communication device 2300 is a smartphone, and includes a processor 2302. Processor 2302 may be an Intel x86 processor, ARM processor or the like. Processor 2302 is interconnected with a memory 2304 and persistent storage 2306. Processor 2302 is further interconnected with one or more display devices 2308 and one or more input device 2310, such a touch-sensitive panel, keyboard or the like.

Processor 2302 may be further interconnected with a plurality of communications radios. For example, mobile communication device 2300 may have at least one cellular radio 2312 for voice or data communications on a wireless network. Processor 2302 may also be interconnected with a Wi-Fi radio 2314, a Bluetooth radio 2316 and a near-field communication (NFC) radio 2318. Cellular radio 2312 may be operable, for example, to interface mobile communication device a 2G/3G/4G/LTE GSM or CDMA cellular network. Wi-Fi radio 2314 may be operable to wirelessly interface mobile communication device 2300 to a local-area network, for example, using IEEE 802.11a/b/g/n/ac standards. Bluetooth radio 2316 may be operable to interface mobile communication device 2300 with neighbouring Bluetooth devices, such as a padlock device, according to a Bluetooth protocol, such as Bluetooth Low Energy (BLE). NFC radio 2318 may be operable to behave in any of a plurality of standard NFC protocols. NFC radio 2318 may be capable of operating in a plurality of different modes, including NFC card emulation modes, NFC reader/writer modes and NFC peer-to-peer modes. One or more of cellular radio 2312, Wi-Fi radio 2314, Bluetooth radio 2316 and NFC radio 2318 may be capable of receiving signals according to corresponding wireless communication protocols and reporting an associated signal strength.

In this embodiment, one or more components of mobile communication device 2300 are formed as portions of a single semiconductor die, referred to as a "system-on-chip". Alternatively, components may be formed as separate semiconductor dies, in communication through one or more buses on a circuit board.

Figure 24:
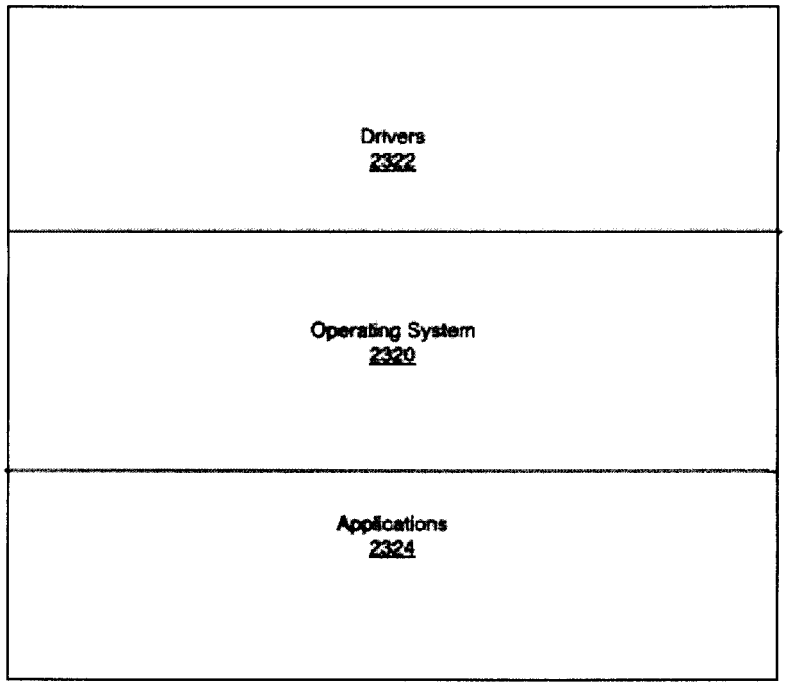
FIG. 24 is a block diagram showing software components at the mobile communication device of FIG. 23.

Mobile device 2300 may operate under control of software stored on storage 2306 and executed by processor 2302. FIG. 24 is a block diagram showing software components at the mobile communication device of FIG. 23. Software components may include an operating system 2320, such as Apple iOS, Android, Microsoft Windows, Linux or the like. Operating system 2320 may interface with hardware components of mobile communication device 2300 by way of drivers 2322. A plurality of software applications 2324 may run within operating system 2320. Operating system 2320 may provide software applications 2324 with access to low-level (e.g. hardware) functions of mobile communication device 2300 by way of application programming interfaces (APIs).

By way of example, software applications 2324 may include a phone dialer, an email client, an internet browser, messaging software applications, social media software applications, media players, and the like. Software applications 2324 may further include one or more software applications for interfacing with the padlock device 100 and for moving data to online databases. Such software applications 2324 may, for example, toggle components such as cellular radio 2312, Wi-Fi radio 2314, Bluetooth radio 2316 and NFC (near field communications) radio 2316 ON or OFF. The software applications 2324 may further enable or disable other software applications from running, or enable or disable specific files or file types from being opened.

In alternative embodiments, the processing structure may incorporate other components such as embedded Bluetooth and/or NFC and/or WiFi radio components thereby integrating such components with the processing structure rather than being separate components.

In this embodiment, software applications 2324 include a software application as described above for collecting user information, providing an account identifier, collecting one or more of a user's fingerprint, and converting the fingerprint to an encrypted user identifier. In an embodiment, the software applications 2324 prevents mobile device 2300 from storing any of the account or user identifiers in persistent storage 2306 on mobile device 2310 and will only allow mobile device 2310 to transmit these identifiers to an online database.

The embodiments of the systems and methods described herein may be implemented in hardware or software, or a combination of both. These embodiments may be implemented in computer programs executing on programmable computers, each computer including at least one processor, a data storage system (including volatile memory or non-volatile memory or other data storage elements or a combination thereof), and at least one communication interface. For example, and without limitation, the various programmable computers may be a server, gaming machine, network appliance, set-top box, embedded device, computer expansion module, personal computer, laptop, personal digital assistant, cellular telephone, smartphone device, UMPC tablets and wireless hypermedia device or any other computing device capable of being configured to carry out the methods described herein.

Program code is applied to input data to perform the functions described herein and to generate output information. The output information is applied to one or more output devices, in known fashion. In some embodiments, the communication interface may be a network communication interface. In embodiments in which elements of the invention are combined, the communication interface may be a software communication interface, such as those for inter-process communication. In still other embodiments, there may be a combination of communication interfaces implemented as hardware, software, and combinations thereof.

Each program may be implemented in a high level procedural or object oriented programming or scripting language, or a combination thereof, to communicate with a computer system. However, alternatively the programs may be implemented in assembly or machine language, if desired. The language may be compiled or interpreted language. Each such computer program may be stored on a storage media or a device (e.g., ROM, magnetic disk, optical disc), readable by a general or special purpose programmable computer, for configuring and operating the computer when the storage media or device is read by the computer to perform the procedures described herein. Embodiments of the system may also be considered to be implemented as a non-transitory computer-readable storage medium, configured with a computer program, where the storage medium so configured causes a computer to operate in a specific and predefined manner to perform the functions described herein.

Furthermore, the systems and methods of the described embodiments are capable of being distributed in a computer program product including a physical, non-transitory computer readable storage medium that bears computer-executable instructions for one or more processors. The medium may be provided in various forms, including one or more diskettes, non-volatile memory and the like. Non-transitory computer-readable storage media may include all computer-readable media, with the exception being a transitory, propagating signal. The term non-transitory is not intended to exclude computer readable storage media such as primary memory, volatile memory, RAM and so on, where the data stored thereon may only be temporarily stored. The computer-executable instructions may also be in various forms, including compiled and non-compiled code.

Throughout the preceding discussion, numerous references will be made regarding servers, services, interfaces, portals, platforms, or other systems formed from computing devices. It should be appreciated that the use of such terms is deemed to represent one or more computing devices having at least one processor configured to execute software instructions stored on a computer readable tangible, non-transitory medium. For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. One should appreciate that the systems and methods described herein may involve interconnected networks of hardware devices configured to receive data using receivers, transmit data using transmitters, and transform electronic data signals using particularly configured processors.

The preceding discussion provided many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

The software and hardware enhancements described herein may be carried out using any type of computer, including portable devices, such as smart phones, that can access a network location or portal via the internet or other communication path (e.g., a LAN or WAN).

The above-described embodiments can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such processors may be implemented as integrated circuits, with one or more processors in an integrated circuit component. A processor may be implemented using circuitry in any suitable format.

Further, it should be appreciated that a computer may be embodied in any of a number of forms, such as a rack-mounted computer, a desktop computer, a laptop computer, or a tablet computer. Additionally, a computer may be embedded in a device not generally regarded as a computer but with suitable processing capabilities, including an EGM, A Web TV, a Personal Digital Assistant (PDA), a smart phone, a tablet or any other suitable portable or fixed electronic device.

Also, a computer may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards and pointing devices, such as mice, touch pads, and digitizing tablets. As another example, a computer may receive input information through speech recognition or in other audible formats.

Such computers may be interconnected by one or more networks in any suitable form, including as a local area network or a wide area network, such as an enterprise network or the Internet. Such networks may be based on any suitable technology and may operate according to any suitable protocol and may include wireless networks, wired networks or fiber optic networks.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, the enhancements to game components may be embodied as a tangible, non-transitory computer readable storage medium (or multiple computer readable storage media) (e.g., a computer memory, one or more floppy discs, compact discs (CD), optical discs, digital video disks (DVD), magnetic tapes, flash memories, circuit configurations in Field Programmable Gate Arrays or other semiconductor devices, or other non-transitory, tangible computer-readable storage media) encoded with one or more programs that, when executed on one or more computers or other processors, perform methods that implement the various embodiments discussed above. The computer readable medium or media can be transportable, such that the program or programs stored thereon can be loaded onto one or more different computers or other processors to implement various aspects as discussed above. As used herein, the term "non-transitory computer-readable storage medium" encompasses only a computer-readable medium that can be considered to be a manufacture (i.e., article of manufacture) or a machine.

The terms "application", "program" or "software" are used herein in a generic sense to refer to any type of computer code or set of computer-executable instructions that can be employed to program a computer or other processor to implement various aspects of the present invention as discussed above. Additionally, it should be appreciated that according to one aspect of this embodiment, one or more computer programs that when executed perform methods as described herein need not reside on a single computer or processor, but may be distributed in a modular fashion amongst a number of different computers or processors to implement various aspects.

Computer-executable instructions may be in many forms, such as program modules, executed by one or more computers or other devices. Generally, program modules include routines, programs, objects, components, data structures, or the like that perform particular tasks or implement particular abstract data types. Typically the functionality of the program modules may be combined or distributed as desired in various embodiments.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that conveys relationship between the fields. However, any suitable mechanism may be used to establish a relationship between information in fields of a data structure, including through the use of pointers, tags or other mechanisms that establish relationship between data elements.

Various aspects of the present game enhancements may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments. While particular embodiments have been shown and described, changes and modifications may be made.

For example, while the biometric sensor 108 of padlock device 100 has been described in embodiments as a capacitive-type fingerprint sensor, alternatives are possible. For example, an optical-type fingerprint sensor may be employed. Furthermore, biometric sensor 108 may be some other kind of sensor, such as a retinal scanner for scanning a user's retina instead of his or her fingerprint. Different processing algorithms for processing retinal image data versus sensed fingerprint data would be required, and additional processing power may be required for same, but the various data structures and overall structure would likely be quite similar to that described above.

In an alternative embodiment, a padlock device according to the invention does not incorporate a biometric sensor 108. Rather, opening padlock device may be done another way, such as by via the authorized communications between an external device and such a padlock device, or via some external biometric sensor 108 that can authenticate the user and instruct the padlock device to enter the release condition.

In an alternative embodiment, a padlock device according to the invention does not incorporate a rechargeable battery that is rechargeable through a charging port, and instead incorporates a non-rechargeable battery that can be replaced by a user.

In an alternative embodiment, the processing structure of the padlock device may incorporate multiple processors coordinated to collectively process fingerprint data and manage the control system or each processor may be dedicated to a separate function, as design needs may require.

Management interface presented by padlock device 100 has been described in embodiments herein as a point of (authorized) access to padlock device 100 that is somewhat of an application programming interface presenting available "function calls" for enabling an external device that is authorized to communicate with padlock device 100 to, for example, enroll a new fingerprint, delete an individual fingerprint, request access history, unlock padlock device 100, and the like, without the external device having to know precisely how padlock device 100 is implemented. This provides a layer of abstraction that is useful in that it the external device does not have to know very much about the underlying implementation details of padlock device 100 (such as the instruction set for processing structure 135, or the memory management details of internal processor-readable memory) in order to execute the functions and request information as required. This also enables padlock device 100 in some embodiments to have some regard for managing its own security rather than being entirely transparent to, and manipulable by, an external device. However, alternatives are possible. For example, an alternative implementation of management interface may be less abstracted, serving substantially as an authorized point of access through which the external device can, for example, send instructions using the particular instruction set of processing structure 135, and/or can send and receive data directly to and from internal processor-readable memory to manage individual fingerprints.

While in embodiments described the processing structure comprises two microprocessors working together in a master-slave relationship, with the second microprocessor being employed mainly for fingerprint-related tasks, alternatives are possible. For example, in alternative embodiments the second microprocessor may be provisioned to be more involved in unlocking functions such as operating the latch subsystem in response to detecting a release condition. In another alternative embodiment, the processing structure could include only one microprocessor for all functions, or could include more than two microprocessors working in coordination.

What is claimed is:

1. A padlock device comprising:

a housing;

a shackle associated with the housing and having, with respect to the housing, a closed configuration and an open configuration;

a latch subsystem associated with the housing for securely retaining the shackle in the closed configuration, the latch subsystem electrically operable to release the shackle;

a biometric sensor associated with the housing to electronically sense fingerprint data from a finger being sensed;

a control subsystem in the housing in communication with the biometric sensor and the latch subsystem, the control subsystem comprising:

internal processor-readable memory configured to store one or more fingerprint records, each fingerprint record comprising authorized fingerprint data associated with a respective fingerprint identifier;

processing structure configured to receive sensed fingerprint data from the biometric sensor and to cause the latch subsystem to release the shackle in the event of a release condition requiring at least that the sensed fingerprint data corresponds to authorized fingerprint data in at least one of the fingerprint records;

the processing structure configured to present a management interface accessible by at least one external device that is in authorized communication with the padlock device to selectively:

store one or more fingerprint records in the internal processor-readable memory; and delete or disable one or more stored fingerprint records in the internal processor-readable memory based at least on one or more respective fingerprint identifiers provided by the external device wherein authorized communication between an external device and the padlock device is established based on at least one authentication string that is generated anew in response to each connection being established between the external device and the padlock.

2. The padlock device of claim 1, wherein the processing structure is configured to present the management interface accessible by the external device that is in authorized communication with the padlock device to selectively:

cause the latch subsystem to release the shackle without the control subsystem being in the release condition.

3. The padlock device of claim 1, wherein the processing structure is configured to automatically create and store at least one history record in the internal processor-readable memory each time the shackle is released, each history record comprising a fingerprint identifier.

4. The padlock device of claim 3, wherein each history record further comprises at least one of: date/time information and location information.

5. The padlock device of claim 3, wherein the management interface is accessible by the external device that is in authorized communication with the padlock device to selectively:

provide at least a subset of the history records to the authorized external device.

6. The padlock device of claim 1, wherein the padlock device is powered by at least one battery and the management interface is accessible by the external device that is in authorized communication with the padlock device to selectively:

provide information about the at least one battery to the authorized external device.

7. The padlock device of claim 1, wherein the control subsystem comprises a wireless transceiver for wirelessly communicating with an external device.

8. The padlock device of claim 1, wherein at least one fingerprint record is stored in association with one or more authorized time windows, wherein the release condition further requires that a time at which the sensed fingerprint data is sensed by the biometric sensor falls within one of the one or more authorized time windows for the corresponding at least one fingerprint record.

9. The padlock device of claim 1, wherein the release condition further requires that additional sensed fingerprint data be sensed by the biometric sensor and that the additional sensed fingerprint data corresponds to authorized fingerprint data in at least one other of the fingerprint records.

10. The padlock device of claim 1, wherein at least one authentication string is generated anew for or by the external device using information stored remotely from the external device and the padlock device.

11. A padlock system comprising:

the padlock device of claim 1; and a non-transitory processor-readable medium embodying a computer program for provisioning an external device to conduct authorized communications with the padlock device, the computer program comprising:

program code for presenting a user interface on the external device for enabling an authorized manager to conduct managing of fingerprint records for the padlock device; and program code for accessing the management interface of the padlock device in accordance with the managing.

12. The padlock system of claim 11, wherein the program code for accessing the management interface comprises:

program code for generating a new fingerprint identifier; and program code for sending the new fingerprint identifier to the padlock device via the management interface with an instruction to add a new fingerprint record, the processing structure of the padlock device is configured to create and store a new fingerprint record using the new fingerprint identifier and fingerprint data coincidentally electronically sensed by the biometric sensor of the padlock device.

13. The padlock system of claim 11, wherein the program code for accessing the management interface comprises:

program code for generating a new fingerprint identifier and capturing fingerprint data using the external device; and program code for sending the new fingerprint identifier and the captured fingerprint data to the management interface with an instruction to add a new fingerprint record, wherein the processing structure of the padlock device is configured to create and store a new fingerprint record using the new fingerprint identifier and fingerprint data sent from the external device.

14. The padlock system of claim 11, wherein the program code for accessing the management interface comprises:

program code for enabling the authorized manager to select a fingerprint identifier; and program code for sending the selected fingerprint identifier to the management interface with an instruction to delete or disable a corresponding fingerprint record stored in the processor-readable memory of the padlock device.

15. The padlock device of claim 1, wherein the processing structure generates the fingerprint identifier.

16. The padlock device of claim 1, wherein the fingerprint identifier for a new fingerprint record is received from the external device via the management interface.

17. A processor-implemented method of operating a padlock device having a housing and a shackle associated with the housing, the shackle having, with respect to the housing, a closed configuration and an open configuration, the method comprising:

storing one or more fingerprint records in an internal processor-readable memory of the padlock device, each fingerprint record comprising authorized fingerprint data associated with a respective fingerprint identifier;

causing a latch subsystem associated with the housing to securely retain the shackle in the closed configuration;

causing a biometric sensor to electronically sense fingerprint data from a finger being sensed;

in the event of a release condition requiring at least that the sensed fingerprint data corresponds to authorized fingerprint data in at least one of the fingerprint records, causing the latch subsystem to release the shackle thereby to enable the shackle to be in the open configuration;

presenting a management interface accessible by at least one external device that is in authorized communication with the padlock device enabling the external device to selectively:

store one or more fingerprint records in the internal processor-readable memory; and delete or disable one or more stored fingerprint records in the internal processor-readable memory based at least on one or more respective fingerprint identifiers provided by the external device, wherein authorized communication between an external device and the padlock device is established based on at least one authentication string that is generated anew in response to each connection being established between the external device and the padlock.

18. The method of claim 17, further comprising:

presenting the management interface accessible by the external device to selectively cause the latch subsystem to release the shackle.

19. The method of claim 17, further comprising:

creating and storing at least one history record each time the shackle is released, each history record comprising a fingerprint identifier.

20. The method of claim 19, wherein each history record further comprises at least one of:

date/time information and location information.

21. The method of claim 17, further comprising:

providing at least a subset of the history records to the authorized external device.

22. The method of claim 17, further comprising:

presenting the management interface accessible by the external device to selectively provide information about at least one battery powering the padlock device to the authorized external device.

23. The method of claim 17, further comprising:

the padlock device wirelessly communicating with the external device via the management interface.

24. The method of claim 17, wherein at least one fingerprint record is stored in association with one or more authorized time windows, further comprising:

determining the release condition including determining whether a time at which the sensed fingerprint data is sensed by the biometric sensor falls within one of the one or more authorized time windows for the corresponding at least one fingerprint record.

25. The method of claim 17, further comprising:

determining the release condition including determining whether additional sensed fingerprint data required to be sensed by the biometric sensor corresponds to authorized fingerprint data in at least one other of the fingerprint records.

26. The padlock device of claim 1, wherein the external device is a mobile device.

27. The padlock device of claim 10, wherein the at least one authentication string is also generated anew by the padlock device thereby to establish the authorized communication between the padlock device and the external device based on the at least one authentication string.

28. The method of claim 17, wherein the at least one external device is a mobile device.

29. The method of claim 17, wherein the at least one authentication string is also generated anew by the padlock device thereby to establish the authorized communication between the padlock device and the external device based on the at least one authentication string.

* * * * *